US007850295B2

(12) United States Patent
Hashimoto

(10) Patent No.: US 7,850,295 B2
(45) Date of Patent: Dec. 14, 2010

(54) SEMICONDUCTOR DEVICE, INK CARTRIDGE, AND ELECTRONIC DEVICE

(75) Inventor: Nobuaki Hashimoto, Suwa (JP)

(73) Assignee: Seiko Epson Corporation (JP)

( * ) Notice: Subject to any disclaimer, the term of this patent is extended or adjusted under 35 U.S.C. 154(b) by 960 days.

(21) Appl. No.: 11/712,362

(22) Filed: Feb. 28, 2007

(65) Prior Publication Data

US 2007/0211087 A1 Sep. 13, 2007

(30) Foreign Application Priority Data

Mar. 13, 2006 (JP) ..... 2006-067426

(51) Int. Cl.
*B41J 2/175* (2006.01)
*B41J 2/195* (2006.01)

(52) U.S. Cl. ..... 347/86; 347/7

(58) Field of Classification Search ..... 347/5, 347/7, 19, 85, 86, 87; 257/39, 59
See application file for complete search history.

(56) References Cited

U.S. PATENT DOCUMENTS

| | | | | |
|---|---|---|---|---|
| 5,162,817 | A | 11/1992 | Tajika et al. | |
| 5,289,211 | A * | 2/1994 | Morandotti et al. | 347/7 |
| 5,988,783 | A | 11/1999 | Tajika et al. | |
| 6,984,012 | B2 * | 1/2006 | Asauchi | 347/19 |
| 6,994,415 | B2 | 2/2006 | Asauchi et al. | |
| 7,059,696 | B2 | 6/2006 | Eguchi et al. | |
| 7,267,421 | B2 | 9/2007 | Asauchi et al. | |
| 7,446,336 | B2 * | 11/2008 | Yamazaki et al. | 257/59 |
| 7,556,363 | B2 * | 7/2009 | Yamamoto | 347/86 |
| 7,561,052 | B2 | 7/2009 | Arai et al. | |
| 2002/0089555 | A1 | 7/2002 | Kobayashi et al. | |
| 2003/0128245 | A1 | 7/2003 | Walker | |
| 2004/0164302 | A1 | 8/2004 | Arai et al. | |
| 2005/0012766 | A1 | 1/2005 | Fukano et al. | |
| 2005/0231547 | A1 | 10/2005 | Hatasa et al. | |
| 2006/0203017 | A1 | 9/2006 | Eguchi et al. | |
| 2007/0211087 | A1 | 9/2007 | Hashimoto | |
| 2008/0271316 | A1 | 11/2008 | Yamamoto | |
| 2008/0291227 | A1 | 11/2008 | Yamamoto | |
| 2009/0128338 | A1 | 5/2009 | Arai et al. | |

FOREIGN PATENT DOCUMENTS

| | | |
|---|---|---|
| EP | 1088668 | 4/2001 |
| EP | 1 382 449 | 1/2004 |

(Continued)

*Primary Examiner*—Anh T. N. Vo
(74) *Attorney, Agent, or Firm*—Harness, Dickey & Pierce, P.L.C.

(57) ABSTRACT

A semiconductor device includes: a semiconductor substrate including an active element formation face on which an active element is formed, and a rear face that is on a side opposite to the active element formation face; a penetration electrode penetrating the semiconductor substrate; an element electrode formed on or above the active element formation face; detection electrodes formed on or above the rear face, electrically connected to the element electrode via the penetration electrode, and detecting a remaining amount of the ink by being wet in the ink; a storage circuit storing the remaining amount of ink; an antenna formed on either one of the active element formation face and the rear face, transmitting and receiving information; and a control circuit controlling the detection electrodes, the antenna, and the storage circuit.

14 Claims, 14 Drawing Sheets

FOREIGN PATENT DOCUMENTS

| | | |
|---|---|---|
| EP | 1602490 | 12/2005 |
| JP | 02-198867 | 8/1990 |
| JP | 2000-171285 | 6/2000 |
| JP | 2002-257616 | 9/2002 |
| JP | 2002-283586 | 10/2002 |
| JP | 2003-291367 | 10/2003 |
| JP | 2004-050542 | 2/2004 |
| JP | 2005-251176 | 9/2005 |
| JP | 2005-343037 | 12/2005 |
| JP | 2006-024817 | 1/2006 |
| KR | 2004-0076223 | 8/2004 |

* cited by examiner

SEMICONDUCTOR DEVICE, INK CARTRIDGE, AND ELECTRONIC DEVICE

CROSS-REFERENCE TO RELATED APPLICATION

This application claims priority on Japanese Patent Application No. 2006-067426, filed Mar. 13, 2006, the contents of which are incorporated herein by reference.

BACKGROUND

1. Technical Field

The present invention relates to a semiconductor device, an ink cartridge, and an electronic device.

2. Related Art

There are conventional methods of managing ink consumption of ink cartridges in printers or the like that use ink for recording.

An example of such management methods is one which calculates ink consumption by using software to integrate the number of ink droplets ejected at the recording head and the amount of ink absorbed by maintenance.

However, this management method of using software to calculate ink consumption has problems such as the following.

There is weight variation in the ink droplets ejected in the head.

Although this weight variation of the ink droplets does not affect the image quality, it causes ink consumption amount errors which accumulate in the ink cartridge.

Consequently, the remaining amount of ink obtained by calculation and the actual remaining amount of ink differ, so that ink remains in the ink cartridge even though the remaining amount of ink is displayed as zero.

Users have noticed that exchanging a used ink cartridge with a new one even when ink remains results in a waste of the remaining ink.

In order to solve this problem, Japanese Unexamined Patent Application, First Publication No. 2002-283586 discloses a technique that uses a piezoelectric device to monitor the remaining amount of ink in an ink cartridge.

According to this method, the remaining amount of ink in the ink cartridge can be monitored using changes in the resonance frequency of a residual vibration signal generated by residual vibration of a vibration unit of the piezoelectric device.

However, in Japanese Unexamined Patent Application, First Publication No. 2002-283586, the sensor structure is complex and the accompanying system also becomes complex, increasing manufacturing costs.

Furthermore, when the ink cartridge is set inside a holder, an electrode terminal connected to the piezoelectric device contacts a contact terminal and becomes electrically connected to it.

Consequently, there is concern over the reliability of the electrical contact point between the ink cartridge and the main frame, and users notice that ink is wasted.

In the related art, systems wherein a detector for detecting ink information is independent from a storage unit for storing the ink information often store ink information detected via the main frame in the storage unit.

Consequently it is difficult to synthesize both types of information, and to perform simple and detailed information management such as ensuring that the ink cartridge cannot function unless it is set in the main device.

SUMMARY

An advantage of some aspects of the invention is to provide a semiconductor device, an ink cartridge, and an electronic device, in which it is possible to detect and manage information relating to ink in an ink cartridge accurately and reliably with a simple configuration, while preventing wasteful use of ink and increasing the satisfaction of the user.

A first aspect of the invention provides a semiconductor device including: a semiconductor substrate including an active element formation face on which an active element is formed, and a rear face that is on a side opposite to the active element formation face; a penetration electrode penetrating the semiconductor substrate; an element electrode formed on or above the active element formation face; detection electrodes formed on or above the rear face, electrically connected to the element electrode via the penetration electrode, and detecting a remaining amount of the ink by being wet in the ink; a storage circuit storing the remaining amount of ink; an antenna formed on either one of the active element formation face and the rear face, transmitting and receiving information; and a control circuit controlling the detection electrodes, the antenna, and the storage circuit.

While ink is generally strongly alkaline and chemically corrosive, since in this structure the detection electrodes wet by the ink is formed on or above the rear face of the semiconductor substrate, the active element formed on the active element formation face can be prevented from being affected by the ink.

The remaining amount of ink (actual amount) or the like in the container can be detected by measuring changes in the resistance and current between the detection electrodes when they are wet by the ink.

Therefore, it is possible to reliably ascertain whether ink is present in the ink cartridge.

By this means, it is possible to substitute the ink cartridge without leasing ink in the container. The cost for the user can thereby be reduced. The satisfaction for the user can be increased.

This important feature is common to all the advantageous effects described below.

By using the antenna, it is possible to perform wireless transmissions between the electronic device unit and the ink cartridge, and to refer to content information stored in the storage circuit, write to the storage circuit, and so on, even if the ink cartridge is not attached to the electronic device unit.

The cost of managing the ink information can thereby be reduced.

Since the antenna can be formed on either one of the surface and the bottom face of the semiconductor substrate, it is possible to select whichever will facilitate manufacture, increase the antenna characteristics, and so on, in accordance with the embodiment.

Furthermore, since ink information from the electronic device unit (color, count number of ejected droplets, etc.) and ink information from the detection electrodes on the ink cartridge (remaining amount, actual amount, etc.) can be stored collectively in the storage circuit, information relating to the ink can be managed over a broad range.

It is preferable that, in the semiconductor device of the first aspect of the invention, a part of the penetration electrode be the detection electrode.

Since this configuration uses the penetration electrode as the detection electrode, the surface and bottom face of the semiconductor substrate can be made conductive without extracting an interconnection.

Since an electrode necessary for the semiconductor device can be used, the manufacturing step is simplified and the cost can be reduced.

It is preferable that, in the semiconductor device of the first aspect of the invention, a part of the penetration electrode include a protrusion protruding from the rear face, and the protrusion is the detection electrode.

According to this configuration, since the ink can sufficiently wet the detection electrodes, an incorrect detection signal can be prevented and correct ink information can be obtained.

It is preferable that the semiconductor device of the first aspect of the invention further include: a conductive layer formed on or above the rear face of the semiconductor substrate with a passivation film therebetween; a protective film formed so as to cover the conductive layer; and an opening formed on the protective film, exposing at least a part of the conductive layer. In this structure, the detection electrode is constituted by the part of the conductive layer exposed through the opening.

According to this configuration, since part of the conductive layer exposed through the opening constitutes the detection electrodes, for example, the pitch between adjacent detection electrodes can be increased.

Furthermore, since the size of the detection electrodes can be determined according to the size of the opening, the detection electrodes can be formed at a desired size (range).

It is preferable that the semiconductor device of the first aspect of the invention further include: a conductive layer formed on or above the rear face of the semiconductor substrate with a passivation film therebetween; a protective film formed so as to cover the conductive layer; and an opening formed on the protective film, exposing at least a part of the conductive layer; and a bump formed on the conductive layer exposed through the opening. In this structure, the bump is the detection electrode.

According to this configuration, since the bump is formed on the conductive layer, it is possible to increase the distance between the active element formation face and the detection electrodes, i.e., the relative distance between them in the thickness direction of the semiconductor element.

By this means, it is possible to prevent the active element formation face from being affected by the ink.

It is preferable that the semiconductor device of the first aspect of the invention further include an insulating layer formed on or below a bottom layer of the detection electrodes.

According to this configuration, since the insulating layer is formed on or above the bottom layer of the detection electrodes, it is possible to increase the distance from the semiconductor substrate to the detection electrodes, thereby preventing the active element from being damaged by the ink.

It is preferable that, in the semiconductor device of the first aspect of the invention, the antenna and the detection electrodes be formed directly on the active element formation face or the rear face using the same conductive material as that constituting the active element.

According to this configuration, the integrated circuit including the active element, an ink information transceiver, and the detection electrodes can be formed collectively, simplifying manufacture.

It is preferable that the semiconductor device of the first aspect of the invention further include a plated film formed on a surface of the detection electrode.

According to this configuration, plating using a metal having excellent chemical resistance prevents corrosion of the detection electrodes that is wetted in the ink, and prevents infiltration of ink to the inside, thereby preventing the active element from being affected by the ink.

Since ink is usually strongly alkaline, infiltration of ink can be reliably prevented by using a chemically resistant metal as the plating material.

It is preferable that the semiconductor device of the first aspect of the invention further include a dielectric layer formed on or below a bottom layer of the antenna.

According to this configuration, by forming the dielectric layer on or below the bottom layer of the detection electrode, the distance from the active element formation face to the detection electrodes can be increased, preventing the active element from being damaged by ink.

Forming the dielectric layer on or below the bottom layer of the antenna also enhances the antenna characteristics.

It is preferable that the semiconductor device of the first aspect of the invention further include three or more detection electrodes.

According to this configuration, even if the detection precision of, say, two of the detection electrodes deteriorates due to the presence of an air bubble or dirt between them, it is possible to compensate by the detection precision between the other detection electrodes, and accurate ink information indicating whether ink is present can be obtained.

A second aspect of the invention provides an ink cartridge used for an electronic device unit including an antenna, the ink cartridge including: an ink cartridge casing including a container that accommodates ink; and a liquid sensor including a semiconductor device that detects and manages information relating to the ink accommodated in the container. In this structure, the semiconductor device includes: a semiconductor substrate including an active element formation face on which an active element is formed, and a rear face that is on a side opposite to the active element formation face; a penetration electrode penetrating the semiconductor substrate; an element electrode formed on or above the active element formation face; detection electrodes exposed in the container, formed in the ink cartridge casing, formed on or above the rear face, electrically connected to the element electrode via the penetration electrode, and detecting a remaining amount of the ink by being wet in the ink; a storage circuit storing the remaining amount of ink; an antenna formed on either one of the active element formation face and the rear face, transmitting and receiving information; and a control circuit controlling the detection electrodes, the antenna, and the storage circuit.

According to this configuration, since the semiconductor device has an all-in-one structure including the detection electrodes, the control circuit, the storage circuit, and the antenna, ink information of the electronic device unit (color, count number of ejected droplets, etc.) and ink information of the detection electrodes (remaining amount, actual amount, etc.) can be stored collectively in the storage circuit.

By this means, it is possible to manage a broad range of information relating to the ink.

Therefore, the information can be managed in detail, and useful information can be correctly supplied to the user.

Also, wasteful use of ink can be prevented. Thus, user's satisfaction can be greatly increased.

Since the detection electrodes of the semiconductor device is exposed in the container of the ink cartridge casing, the detection electrodes directly contacts the ink, and can reliably detect a remaining amount of ink (whether ink is present) in the container.

Since parts of the semiconductor device other than the detection electrodes are embedded in the ink cartridge, damage to the active element formed on these other parts caused by the ink can also be prevented. Therefore, unwanted leakage of ink solution can be prevented. Thus, user's satisfaction can be greatly increased.

Moreover, even if the ink cartridge is not set in the electronic device unit, it is possible to refer to content information stored in the storage circuit, write to the storage circuit, and so on, in addition, ink information from the detection electrodes can be stored in the storage circuit without passing via the electronic device unit.

For example, by storing ink information such as whether the ink has been filled, the filling date, the ink finishing date, the number of fillings, and so on, beforehand in the storage circuit, this information can be managed collectively with detailed information relating to the ink itself.

Since the detection electrodes and the storage circuit are formed on the same substrate, it is possible to detect and manage the ink information in ink cartridge units, increasing the versatility of the ink cartridge.

Since management and detection functions can be imparted to the ink cartridge in this manner, the number of interconnections on the electronic device unit decreases, the structure is simplified, and the freedom of the design layout of the electronic device unit can be increased.

By this means, it is possible to substitute the ink cartridge without leaving any ink in the container.

It is preferable that, in the ink cartridge of the second aspect of the invention, a plurality of pairs of the detection electrodes of the semiconductor device be formed along the depth direction of the container, the detection electrodes being arranged along a bottom face of the container.

According to this configuration, as the amount of ink decreases, information (liquid level) indicating that there is no ink between the detection electrodes can be detected sequentially from between the detection electrodes thereabove.

Moreover, when information indicating that there is no ink is detected at the detection electrodes along the bottom face, information indicating that the ink has not completely emptied from the ink cartridge can be obtained.

Thus, it is possible to obtain not only accurate information indicating whether ink is present, but also timely and precise information relating to the gradually decreasing amount of ink.

With this type of configuration, when the remaining amount of ink in the ink cartridge decreases to a level that concerns the user, timely information relating to the remaining amount of ink can be obtained. Thus, user's satisfaction can be greatly increased.

It is preferable that, in the ink cartridge of the second aspect of the invention, a plurality of the semiconductor devices be formed along the depth direction of the container, the detection electrodes of at least one of the semiconductor devices being arranged along a bottom face of the container.

According to this configuration, by forming a plurality of the semiconductor devices along the depth direction of the container, the liquid level of the ink can be detected and the remaining amount of ink can be accurately ascertained.

Furthermore, since the detection electrodes of at least one of the semiconductor devices is arranged along the bottom face of the container, it is possible to reliably detect whether ink is present.

This configuration also obtains timely information relating to the remaining amount of ink in the small remaining amount of ink region that concerns the user. Thus, user's satisfaction can be greatly increased.

A third aspect of the invention provides an electronic device including the abovementioned ink cartridge, and an electronic device unit including an antenna.

According to this configuration, since ink information such as that described above can be detected and managed reliably, for example, an appropriate replacement period for the ink cartridge can be determined.

Since it is possible to substitute the ink cartridge to without leaving any ink in the container, the replacement cycle of the ink cartridge can be extended and the ink-related cost can be reduced.

By this means, waste of the ink is prevented. The user's satisfaction can be greatly increased.

This important feature is common to all the advantageous effects described below.

By managing detailed ink information in this way, the ink cartridge can be recycled efficiently and without waste. This information is useful in achieving functions that are essential in servicing the user.

Information such as the number of recycles of the ink cartridge can be determined from, for example, information relating to the number of ink fillings, this information is useful not only in achieving functions that are essential in servicing the user, but also from an environmental perspective as regards recycling.

Obviously, a highly reliably, high-quality product can thereby be provided.

DESCRIPTION OF EXEMPLARY EMBODIMENTS

Embodiments of a semiconductor device, an ink cartridge, and an electronic device according to the invention will be explained with reference to FIGS. 1 to 15.

Semiconductor devices 1 and 41 are contained in an ink cartridge 7 which is attached to a printer unit 23 (electronic device unit) including a first antenna 22 described later.

Semiconductor Device

Figure 1:
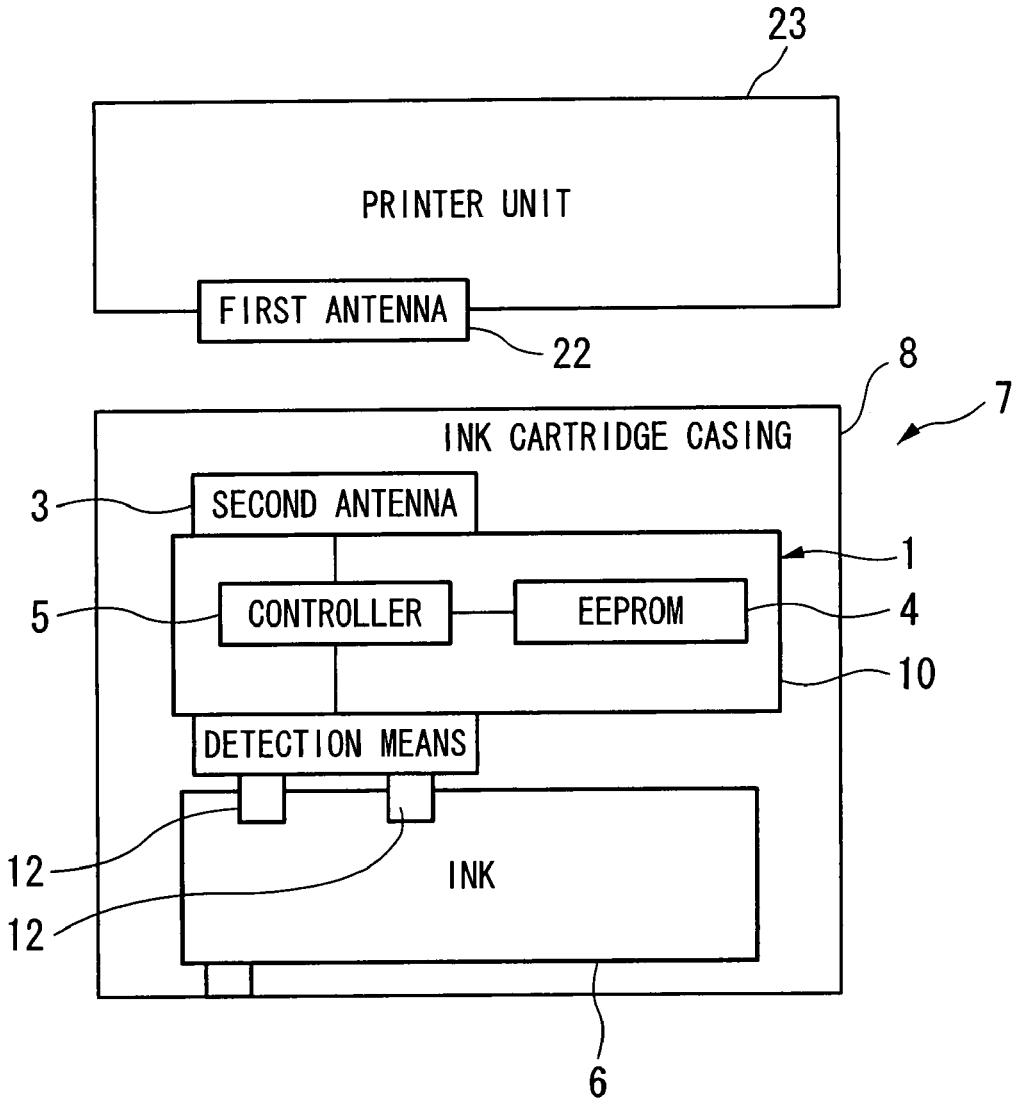
FIG. 1 is a schematic block diagram of an ink jet printer according to an example of the invention.

FIG. 1 is a schematic block diagram of an electronic device of the invention.

Figure 2:
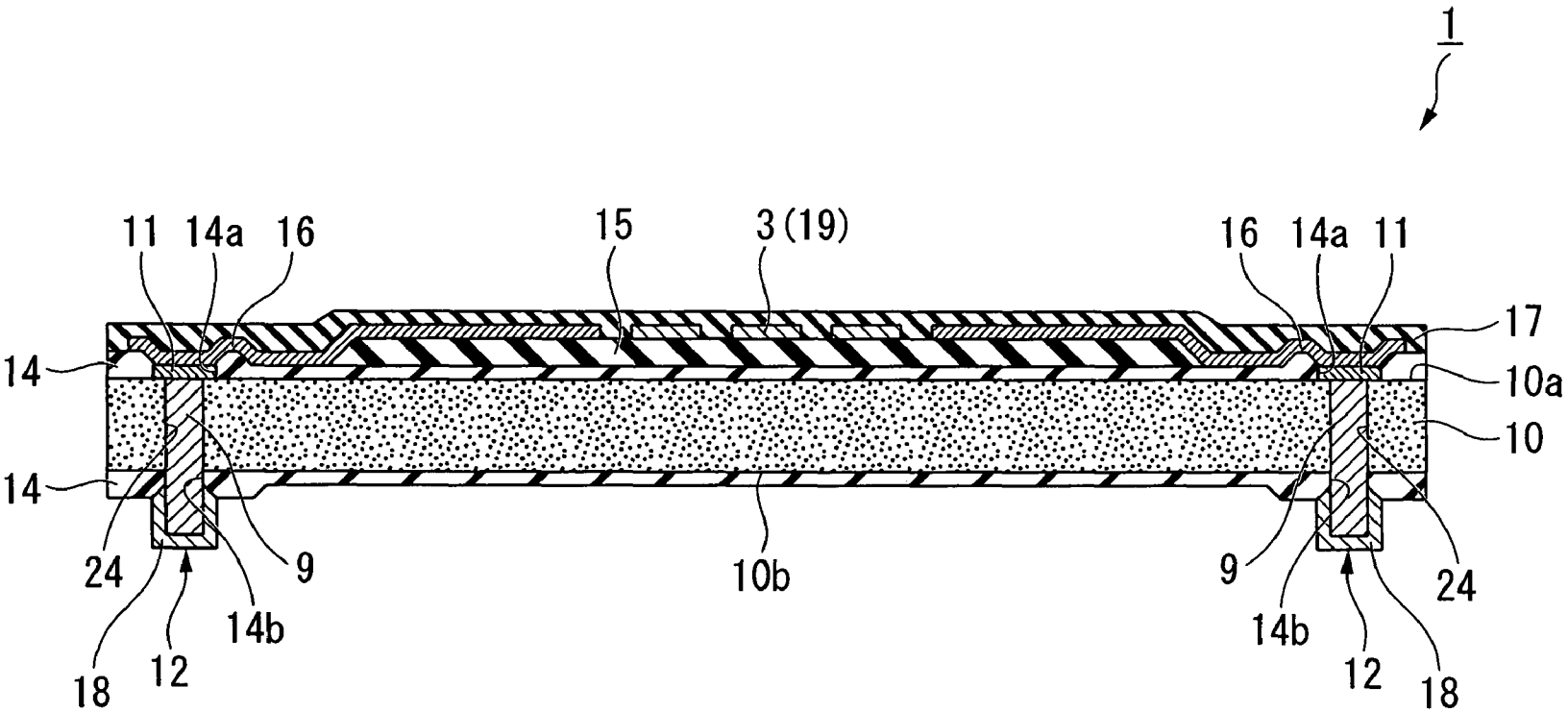
FIG. 2 is a cross-sectional view of a schematic diagram of a semiconductor device according to a first embodiment of the invention.

FIG. 2 is a cross-sectional view of a first embodiment of a semiconductor device of the invention.

Figure 3:
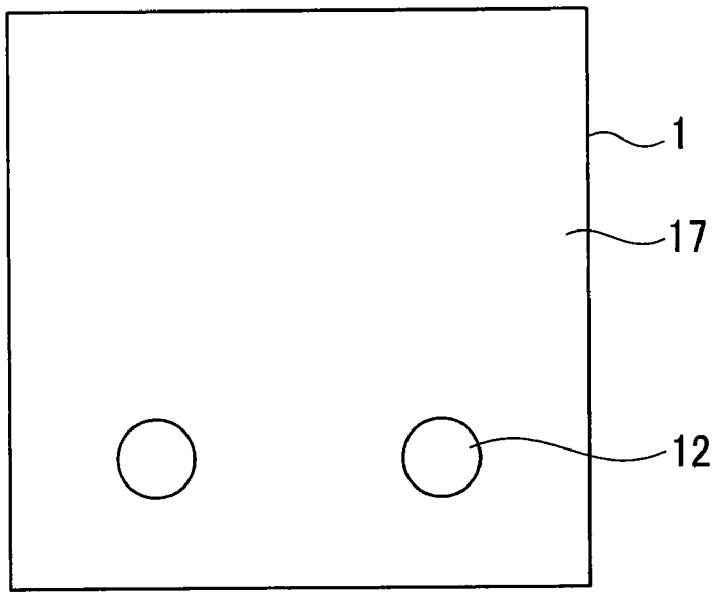
FIG. 3 is a plan view of the exterior of a semiconductor device according to a first embodiment of the invention.

FIG. 3 is an exterior view of a first embodiment of a semiconductor device of the invention.

In these diagrams, reference numeral 1 represents a semiconductor device having a wafer level chip scale package (W-CSP) structure.

The semiconductor device 1 includes liquid contact electrodes 12 (detection electrodes), a second antenna 3, an EEPROM 4 (storage circuit), and a controller 5 (control circuit), which are provided on a rectangular semiconductor substrate 10.

The liquid contact electrodes 12 detect a remaining amount of ink.

The second antenna 3 transmits and receives information to or from a first antenna 22 of the printer unit 23.

The EEPROM 4 stores ink information.

The controller 5 controls the liquid contact electrodes 12, the second antenna 3, and the EEPROM 4.

The semiconductor substrate 10 is made from silicon.

An integrated circuit (not shown) includes the controller 5 and the EEPROM 4 constituted by active elements such as transistors, and is formed on an active element formation face 10*a* (surface) of the semiconductor substrate 10.

The integrated circuit includes at least an interconnection pattern, the EEPROM 4, the controller 5, and other active components being mutually connected by interconnections or the like.

In this embodiment, the EEPROM (nonvolatile memory) 4, which is a readable/writable recording medium, is used as the storage circuit.

The controller 5 performs updates or the like of ink information stored in the EEPROM 4 based on the remaining amount of ink in the ink tank 6 (container).

A pair of element electrodes 11 for making the integrated circuit conductive is provided in a peripheral portion of the active element formation face 10*a* of the semiconductor substrate 10.

Since these element electrodes 11 are formed so as to conduct directly with the integrated circuit of the semiconductor substrate 10, they are arranged in a pair in a peripheral portion of the rectangular semiconductor substrate 10.

Titanium (Ti), titanium nitride (Tin), aluminum (Al), copper (Cu), an alloy of these, or such like, can be used as material for the element electrodes 11.

In this embodiment, aluminum (Al) is used as the material for the element electrodes 11.

The element electrodes 11 formed on the active element formation face are extracted to a rear face 10*b* of the semiconductor substrate 10 via a pair of through-holes 24 that penetrate through the semiconductor substrate 10.

The through-holes 24 penetrate from the active element formation face 10*a* of the semiconductor substrate 10 to the rear face 10*b*.

The through-holes 24 are formed using a conventionally known method such as, for example, photolithography, and have predetermined diameters.

During printing, a conductive paste is embedded in the through-holes 24.

In this manner, the penetration electrodes 9 that function as so-called contact plugs in the through-holes 24 are formed.

A material having low electric resistant such as copper (Cu) and tungsten (W) can be used as the conductive paste.

Since the penetration electrodes 9 are formed by filling the through-holes 24 with the conductive paste in this manner, electrical connection can be achieved between the penetration electrodes 9.

As shown in FIG. 2, the penetration electrodes 9 are formed with protrusion amounts from the rear face 10*b* that greatly exceed the thickness of the passivation film 14 described later. That is, the penetration electrodes 9 include protrusions.

As shown in FIG. 2, the through-holes 24 are formed directly below their respective element electrodes 11.

Since active elements are not normally provided directly below the element electrodes 11, this configuration can minimize the area of the semiconductor substrate 10 without needing to allocate areas for forming the through-holes 24 on the active element formation face 10*a*.

Since this configuration can utilize electrodes that are essential to the semiconductor device 1, the semiconductor device 1 can be made versatile without requiring a customized design.

The element electrodes 11 formed on the active element formation face 10*a* are protected by a passivation film 14 formed on the active element formation face 10*a*.

A passivation film 14 is also provided over the rear face 10*b*, and completely covers it with the exception of the penetration electrodes 9.

The material used for the passivation film 14 is an electrical insulating material such as, for example, polyimide resin, silicone-modified polyimide resin, epoxy resin, silicone-modified epoxy resin, acrylic resin, phenol resin, benzocyclobutene (BCB), and polybenzoxazole (PBO).

It is also possible to use an inorganic material such as silicon oxide ($SiO_2$) and silicon nitride ($Si_3N_4$).

In this embodiment, polyimide resin is used as the material for the passivation film 14.

In the passivation film 14 in the active element formation face 10*a* of the semiconductor substrate 10, a dielectric layer 15 made of insulating resin is formed in a center portion of the semiconductor substrate 10 at a position avoiding the element electrodes 11.

As shown in FIG. 2, the dielectric layer 15 is substantially trapezoidal in cross-sectional view.

The dielectric layer 15 is made from photosensitive polyimide resin, silicone-modified polyimide resin, epoxy resin, silicone-modified epoxy resin, etc.

The formation of the dielectric layer 15 on the active element formation face 10*a* relieves thermal stress of the active element (integrated circuit). The active element's reliable life can be noticeably increased.

Openings 14*a* are formed in the passivation film 14 on or above the active element formation face 10*a*, and are formed above the element electrodes 11. The element electrodes 11 are thereby exposed to the outside in the openings 14*a*.

Relocation interconnections 16 (conductive layers) are electrically connected to the element electrodes 11 in the openings 14*a* of the passivation film 14.

The relocation interconnections 16 are for relocating the element electrodes 11 of the integrated circuit, and are therefore formed extending from the element electrodes 11 arranged in a peripheral part of the semiconductor substrate 10 to the center of the semiconductor substrate 10 and also rising onto the dielectric layer 15.

Figure 5:
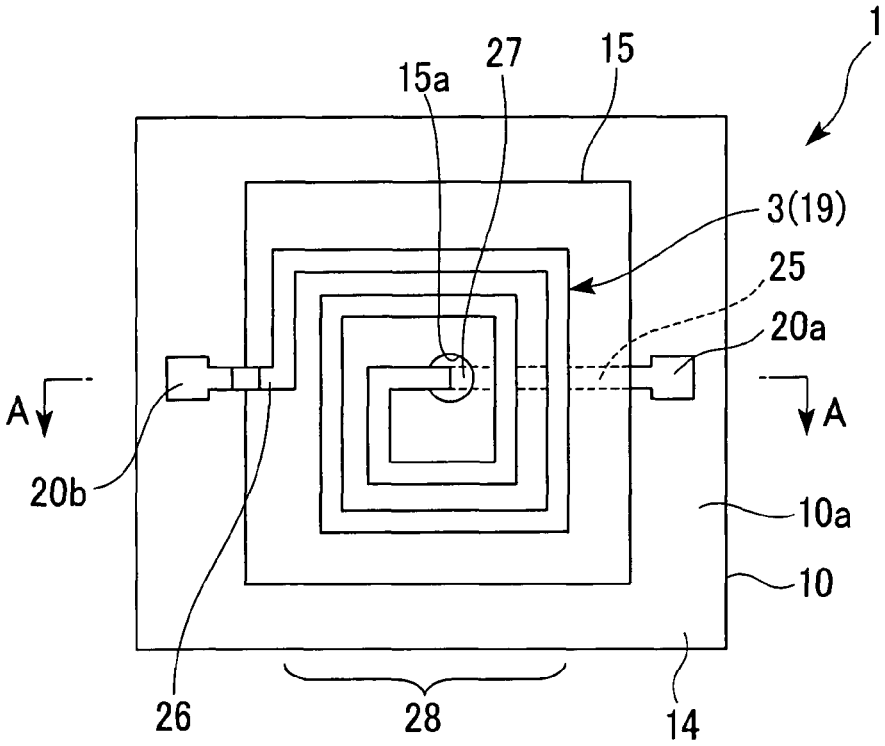
FIG. 5 is plan view of a schematic diagram of a second antenna.

As shown in FIG. 5, in addition to the element electrodes 11, electrodes 20*a* and 20*b* are formed in the integrated circuit on the semiconductor substrate 10 using a material similar to that of the element electrodes 11.

A relocation interconnection 19 (conductive layer) is connected to the electrodes 20*a* and 20*b* in the same manner as the element electrodes 11.

The relocation interconnection 19 extends from the electrodes 20*a* and 20*b* to the center portion and rises onto the dielectric layer 15.

The relocation interconnection 19 that rises onto the dielectric layer 15 is arranged so as not to interfere with the relocation interconnection 16 (see FIG. 2), and forms the second antenna 3 that communicates with the first antenna 22 of the printer unit 23.

The second antenna 3 is provided substantially in the center portion of the semiconductor substrate 10, and is constituted by a flat-type inductor element (spiral inductor element).

Figure 6:
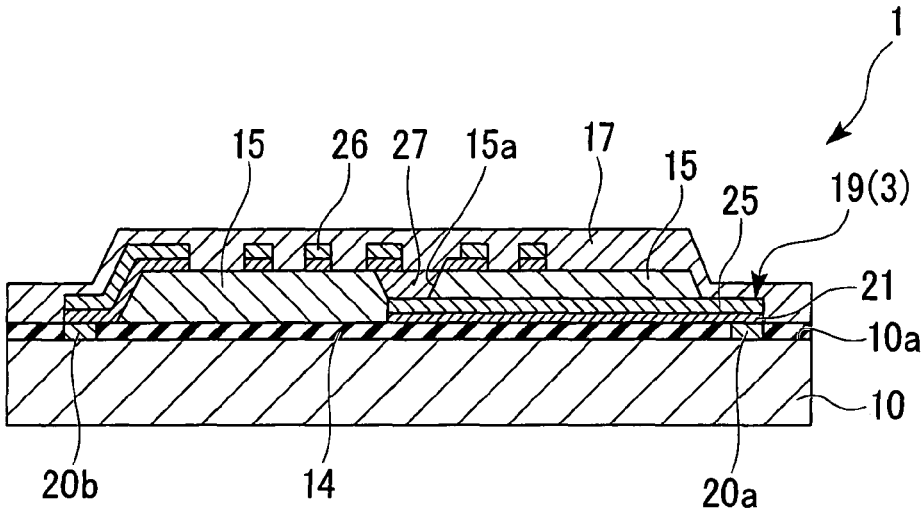
FIG. 6 is a cross-sectional view of a schematic diagram of a second antenna.

As shown in FIG. 6, the relocation interconnection 19 arranged on the surface of the dielectric layer 15 is formed on the same flat face in cross-sectional view, and has a spiral shape in the plan view shown in FIG. 5.

The second antenna 3 is formed by the relocation interconnection 19 arranged from the electrode 20*a* of the semiconductor substrate 10 across to the electrode 20*b*. Also, as shown in FIG. 6, the second antenna 3 includes an bottom layer interconnection 25 formed at the bottom of the dielectric layer 15, and a upper-layer interconnection 26 formed at the top of the dielectric layer 15.

The bottom layer interconnection 25 and the upper-layer interconnection 26 are connected via a connector 27 that is formed by embedding Cu in a hole 15*a* formed in the dielectric layer 15.

Thus, the upper-layer interconnection 26 is arranged so as not to be short-circuitting with the bottom layer interconnection 25 on the passivation film 14.

Of the bottom layer interconnection 25 and the upper-layer interconnection 26, the upper-layer interconnection 26 is relatively separated from the semiconductor substrate 10 and forms a spiral section 28 such as that shown in FIG. 5.

Since the dielectric layer 15 is formed between the spiral section 28 and the semiconductor substrate 10, the spiral section 28 can be further separated from the semiconductor substrate 10.

The inside ends of the second antenna 3 are joined to the electrode 20*a* via the bottom layer interconnection 25 of the relocation interconnection 19.

The outside ends are joined to the electrode 20*b* via the upper-layer interconnection 26.

Forming the second antenna 3 (spiral section 28) on the dielectric layer 15 in this manner achieves clearance with the semiconductor substrate 10, which is an electromagnetic wave absorber, thereby reducing current leakage from the second antenna 3 and increasing its transmission efficiency.

The antenna characteristics are enhanced by forming the second antenna 3 on the dielectric layer 15 in this manner.

When the dielectric constant of the dielectric layer 15 is increased, a second antenna 3 of short length can be formed in a narrow area. It is possible to miniaturize the semiconductor device 1 and also helping to reduce the manufacturing cost.

While single-layer film, multi-layered film, or alloy film of gold (Au), copper (Cu), silver (Ag), titanium (Ti), tungsten (W), titanium tungsten (TiW), titanium nitride (TiN), nickel (Ni), nickel vanadium (NiV), chrome (Cr), aluminum (Al), palladium (Pd), and so on, can be used as the material used for the relocation interconnections 16 and the 19, in this embodiment they are formed from Cu plated film.

As shown in FIG. 6, a sputtering layer 21 of Cu is formed on the bottom of the second antenna 3. This sputtering layer 21 is used in plating to form the second antenna 3.

As shown in FIG. 2, a protective layer 17 (protective film) is then formed on the active element formation face 10*a* of the semiconductor substrate 10 so as to cover the relocation interconnections 16 (second antenna 3), the dielectric layer 15, and the passivation film 14.

The protective layer 17 is made from a heat-resistant material of solder resist.

For example, an alkali-resistant resin such as polyimide resin, PPS, and PE is used for forming the protective layer 17.

Alternatively, SiN, $SiO_2$, SiON, or the like, can used to form an inorganic film.

It is preferable that a material having a liquid repellency to the ink be used for the protective layer 17 in order to prevent a decrease in the resistance between the liquid contact electrodes 12 caused by ink remaining on the surface of the protective layer 17 (in order to enhance the S/N ratio of the wetted sensor) when the ink in the ink tank decreases to a small amount. In this embodiment, polyimide resin is used.

The surface of the protective layer 17 can be treated with a process such as fluorination treatment and silicone treatment. This broadens the range of resin materials that can be selected, even if the overall protective layer 17 does not have a liquid repellency to the ink.

The protective layer 17 can also cover the side faces of the semiconductor device 1.

By this means, the semiconductor device 1 from being damaged by the ink in prevented.

Openings 14*b* are also provided in the passivation film 14 on or above the rear face 10*b*.

In this configuration, the tips of the penetration electrodes 9 protrude to the outside from the openings 14*b*.

In this embodiment, the tips of the penetration electrodes 9 protruding from the openings constitute the liquid contact electrodes 12 that function as detection electrodes for detecting ink information.

By using the penetration electrodes 9 as detection electrodes in this way, the number of interconnections on or above the rear face 10*b* can be reduced and the configuration can be simplified.

It is possible to detect whether ink is present by measuring the resistance and current between the liquid contact electrodes 12.

For example, if one liquid contact electrode 12 is connected to a transistor gate of a controller circuit and the other liquid contact electrode 12 is connected to the power source, a transistor that is ON when there is ink will switch OFF when there is no ink.

By detecting this, it is possible to determine whether ink is present.

In order to prevent deterioration in the ink composition due to electrolysis, it is preferable that the current flowing between the liquid contact electrodes 12 be made as small as possible, and be pulsed.

Since the pair of liquid contact electrodes 12 is wet in the ink, Au-plated film 18 is grown on their surfaces.

A metal which has excellent chemical resistance and is not affected by a strong alkaline ink component is preferably used as the plated film, instead of this Au-plated film, Pt-plated film, Ni-p plated film, and such like can also be used.

In the semiconductor device 1 of the above configuration, since the liquid contact electrodes 12 are formed on the rear face 10*b* of the semiconductor substrate 10, there is not concern that the ink is infiltrated to the active element formation face 10*a*, whereby the active elements can be reliably prevented from being affected by the ink Since the relocation interconnection 16 and the relocation interconnection 19 can be formed so as to constitute the same layer on the same face, they can be formed simultaneously.

By this means, the number of manufacturing steps is reduced, and the manufacturing cost is reduced.

FIG. 3 is an example of the exterior of the semiconductor device 1 of the invention shown in a cross-sectional view in FIG. 2.

In this example, detection electrodes include a pair of liquid contact electrodes 12, it being possible to detect whether ink is present by measuring the resistance and current between them.

Figure 4:
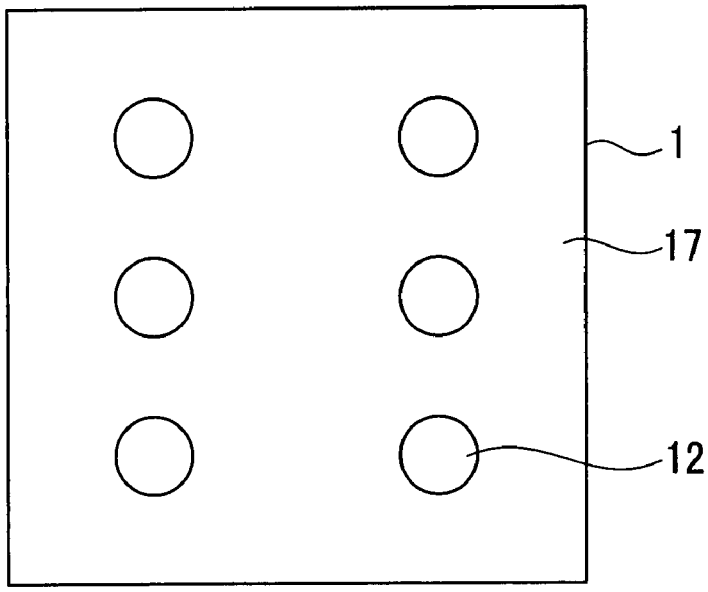
FIG. 4 is a plan view of the exterior of another embodiment of a semiconductor device.

FIG. 4 is another example of the exterior of the semiconductor device 1 of the invention shown in a cross-sectional view in FIG. 2.

In this example there are six liquid contact electrodes 12.

With this arrangement, even if the detection precision of a pair of liquid contact electrodes 12 decreases due to air bubbles or dirt between them, the detection precision can be supplemented by the other pairs of liquid contact electrodes 12. It is possible to obtain accurate information relating to whether ink is present.

In this case, reduction in precision can be prevented by using more than two (more than one pair of) liquid contact electrodes 12. The detection precision increasing as the number of liquid contact electrodes 12 increases.

Second Embodiment

A second embodiment will be described with reference to FIG. 7.

Figure 7:
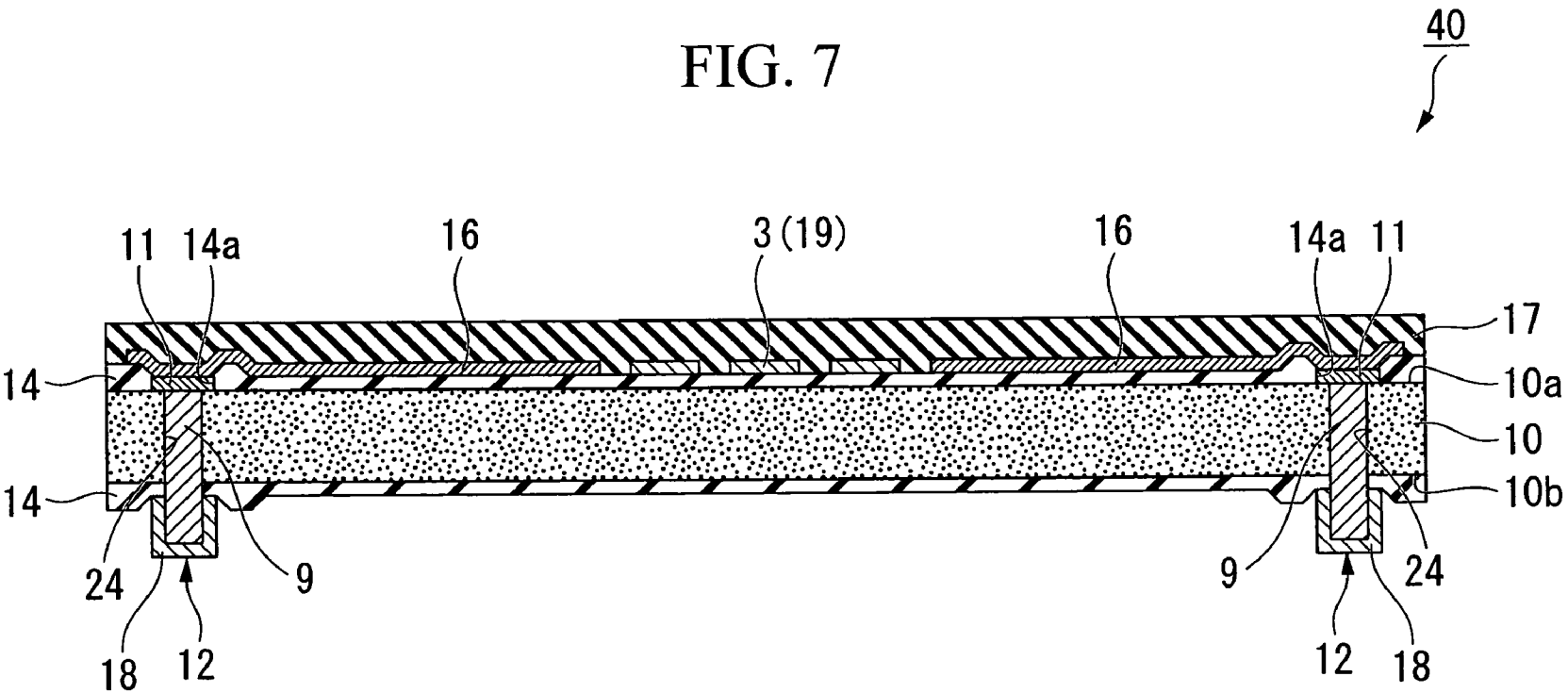
FIG. 7 is a cross-sectional view of a schematic diagram of a semiconductor device according to a second embodiment of the invention.

In FIG. 7, parts corresponding to those in FIGS. 1 to 6 are represented by same reference numerals, and are not repetitiously explained.

Reference numeral 40 represents a semiconductor device of the invention whose basic configuration is similar to that of the embodiment described above.

This embodiment differs from the first embodiment in that the second antenna 3 is formed directly on the passivation film 14 without providing the dielectric layer 15 therebetween.

In this embodiment, the liquid contact electrodes 12 are formed on the rear face 10*b* which is on the opposite side of the semiconductor substrate 10 to the active element formation face 10*a*.

By this means, since there is not concern that the ink infiltrates to the active element formation face 10*a*, the distance in the thickness direction of the semiconductor substrate 10 need not be increased by forming the dielectric layer 15.

Since the step of forming the dielectric layer 15 is omitted, the number of manufacturing steps is reduced and the manufacturing efficiency can be increased.

Moreover, since all the interconnections (16 and 19) can be formed on the same flat face (i.e., on the flat active element formation face 10*a*), the second antenna 3 can be easily formed.

At this time, forming the second antenna 3 using the interconnection used for forming the integrated circuit on the active element formation face 10*a*, such as, for example, Al and Cu, it is possible to form them in the same step.

Since no other materials are required, the time and cost of manufacture can be reduced.

While the first and second embodiments describe examples where penetration electrodes 9 are used as detection electrodes, this is not limitative of the invention.

In the following embodiments, instead of making the penetration electrodes 9 function as detection electrodes, relocation interconnections are connected to the penetration electrodes 9 and used as detection electrodes.

According to this configuration, the penetration electrodes 9 need not protrude from the rear face 10*b* as they do in the first and second embodiments.

The basic configuration is otherwise the same as the first and second embodiments, in that the detection electrodes are provided on the rear face 10*b* of the semiconductor substrate 10 instead of the active element formation face 10*a*.

Other embodiments will be explained taking this configuration as assumed.

Third Embodiment

A third embodiment will be explained with reference to FIG. 8.

Reference numeral 41 represents a semiconductor device of the invention.

This embodiment differs from the first and second embodiments in that the second antenna 3 and liquid contact electrodes 46 (detection electrodes) using relocation interconnections 16 are formed on the rear face 10*b* of the semiconductor substrate 10.

Figure 8:
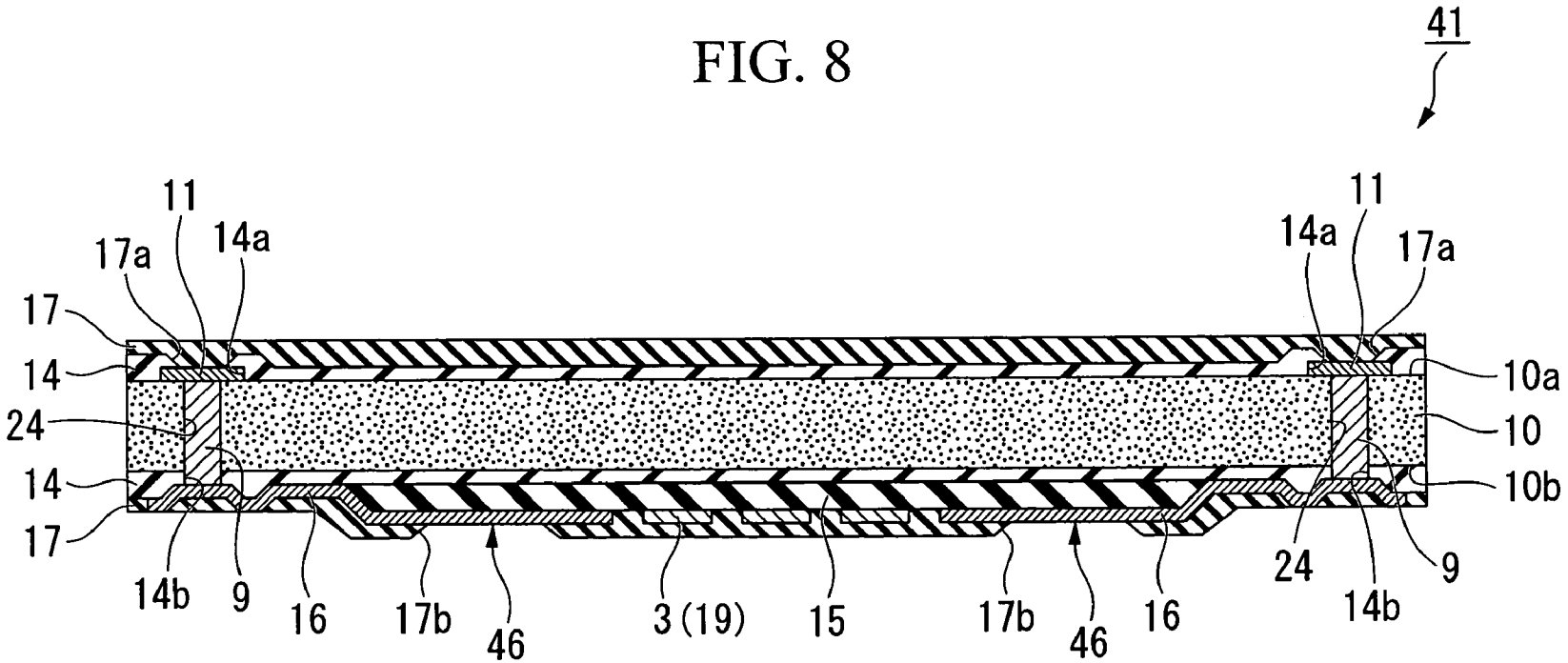
FIG. 8 is a cross-sectional view of a schematic diagram of a semiconductor device according to a third embodiment of the invention.

In FIG. 8, parts corresponding to those in FIGS. 1 to 6 are represented by same reference numerals, and are not repetitiously explained.

In the semiconductor device of this embodiment, an integrated circuit and a passivation film 14 are formed on the active element formation face 10*a* of the semiconductor substrate 10.

The integrated circuit includes a controller 55 and an EEPROM 4, these being formed on the active element formation face 10*a*.

The passivation film 14 covers a pair of element electrodes 11.

As shown in FIG. 8 in this embodiment, the element electrodes 11 are exposed in openings 14*a* formed in the passivation film 14.

Instead of forming openings 14*a* in the passivation film 14, for example, the passivation film 14 can cover the entire active element formation face 10*a* including the element electrodes 11.

A protective layer 17 is then formed over the passivation film 14 so as to cover the element electrodes 11 exposed via the openings 14*a*.

By this means, the active element formation face 10*a* is protected.

As shown in FIG. 8, a dielectric layer 15 is formed on the passivation film 14 on the rear face 10*b* of the semiconductor substrate 10 so as to avoid a pair of penetration electrodes 9 which penetrate through the thickness direction of the semiconductor substrate 10 and are formed in a peripheral section of the semiconductor substrate 10, i.e., the dielectric layer 15 is formed in the center of the semiconductor substrate 10.

Relocation interconnections 16 are electrically connected to the penetration electrodes 9 in the openings 14*b* of the passivation film 14.

The penetration electrodes 9 are relocated on the rear face 10*b*.

The relocation interconnections 16 extend from the penetration electrodes 9 to the center portion of the semiconductor substrate 10, and rise onto the dielectric layer 15.

The relocation interconnections 16 are connected to the liquid contact electrode 46 described below.

These relocation interconnections are an important means of deviating the positions of the element electrodes 11 of the semiconductor substrate 10 that is often designed in minute detail and the physical positions of the rough-pitch liquid contact electrodes 46.

In addition to the element electrodes 11, electrodes 20*a* and 20*b* are formed on the rear face 10*b* of the semiconductor substrate 10 using a material similar to that of the element electrodes 11 (see FIG. 5).

While in FIG. 5 the second antenna 3 is formed on the active element formation face 10*a*, only the configuration of the second antenna 3 is depicted.

As same as the penetration electrodes 9, a relocation interconnection 19 is also connected to the electrodes 20*a* and 20*b*.

The relocation interconnection 19 extends from the electrodes 20*a* and 20*b* to the center portion and rises above the dielectric layer 15.

The relocation interconnection 19 that rises onto the dielectric layer 15 is arranged so as not to interfere with the relocation interconnection 16 and constitutes the second antenna 3 that communicates with the first antenna 22 on the printer unit 23.

The second antenna 3 has the same configuration as in the above embodiments.

A protective layer 17 is then formed on the rear face 10*b* so as to cover the second antenna 3, the passivation film 14, the relocation interconnections 16, and the dielectric layer 15.

Openings 17*a* are formed in each relocation interconnection 19 of the dielectric layer 15.

In this configuration, parts of the relocation interconnection 19 exposed through the openings 17*a* constitute the liquid contact electrodes 46 (detection electrodes).

Since the liquid contact electrodes 46 are wet in the ink, they are plated with the alkali-resistant metal described above. A plated layer is formed (not shown).

By using parts of the relocation interconnections 16 as the liquid contact electrodes 46 and providing the dielectric layer 15 between the liquid contact electrodes 46 and the semiconductor substrate 10, the semiconductor substrate 10 can be reliably prevented from being affected by the ink.

According to this embodiment, since the liquid contact electrodes 46 and the second antenna 3 are provided on the rear face 10*b* on the opposite side of the semiconductor substrate 10 to the active element formation face 10*a*, the relocation interconnections 16 and the second antenna 3 (relocation interconnection 19) can be formed simultaneously.

Furthermore, since the relocation interconnections 16 and the second antenna 3 can be formed so as to constitute the same layer on the same face, the number of manufacturing steps can be reduced, and so can the manufacturing cost.

It is preferable that the dielectric layer 15 be formed below the liquid contact electrodes 46 and the second antenna 3. By this means, it is possible to increase the distance between the semiconductor substrate 10 and the liquid contact electrodes 46. It is possible to enhance the antenna characteristics. It is possible to maintain a distance from the semiconductor substrate 10 to the liquid contact electrodes 46.

By this means, the ink from infiltrating inside the semiconductor device 40 is prevented.

Fourth Embodiment

A fourth embodiment will be explained with reference to FIG. 9.

Figure 9:
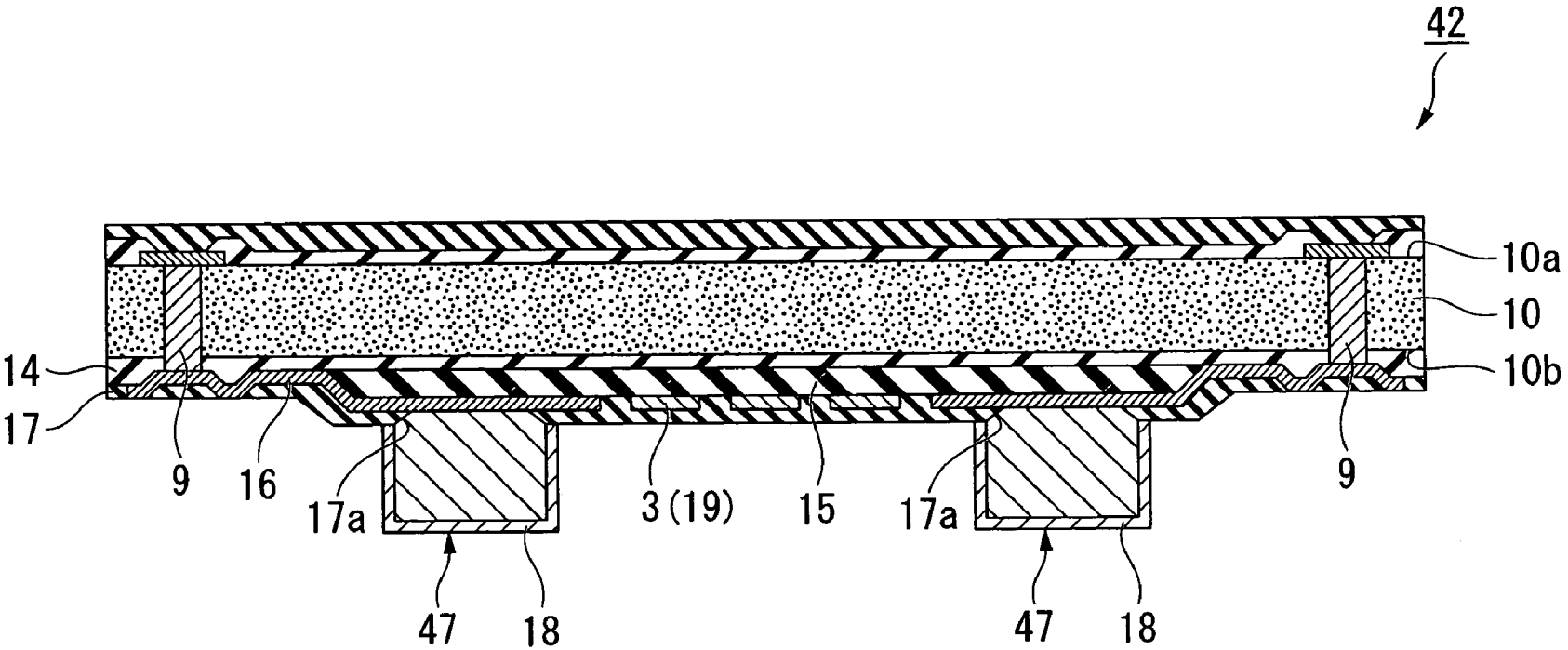
FIG. 9 is a cross-sectional view of a schematic diagram of a semiconductor device according to a fourth embodiment of the invention.

In FIG. 9, parts corresponding to those in FIGS. 1 to 6 are represented by same reference numerals, and are not repetitiously explained.

Reference numeral 42 represents a semiconductor device of this embodiment.

This embodiment differs from the third embodiment in that bumps are formed on the relocation interconnections 16 exposed via the openings 17*a* in the protective layer 17 on the rear face 10*b*, these bumps being made to function as liquid contact electrodes 47 (detection electrodes).

As shown in FIG. 9, the bumps are formed on the relocation interconnections 16 exposed via the openings 17*a* in the protective layer 17 by growing Au-plated film 18 on the surface of a core of Cu that can be plated at high speed.

The bumps function as liquid contact electrodes 47 that detect ink information when they are wet with ink.

By forming the Au-plated film 18 on the surface of the Cu core, infiltration of ink to the semiconductor substrate 10 can be reliably prevented.

Also, since the dielectric layer 15 is already formed below the liquid contact electrodes 47, the distance from the semiconductor substrate 10 to the liquid contact electrodes 47 can be increased, further preventing semiconductor substrate 10 from being affected by the ink.

While the third and fourth embodiments describe configurations where the second antenna 3 is formed on the rear face 10*b* on which the liquid contact electrodes are formed, in the following embodiment, the second antenna 3 is formed on or above the active element formation face 10*a*.

The basic configuration is otherwise the same as that of the above embodiments.

Fifth Embodiment

A fifth embodiment will be explained with reference to FIG. 10.

Figure 10:
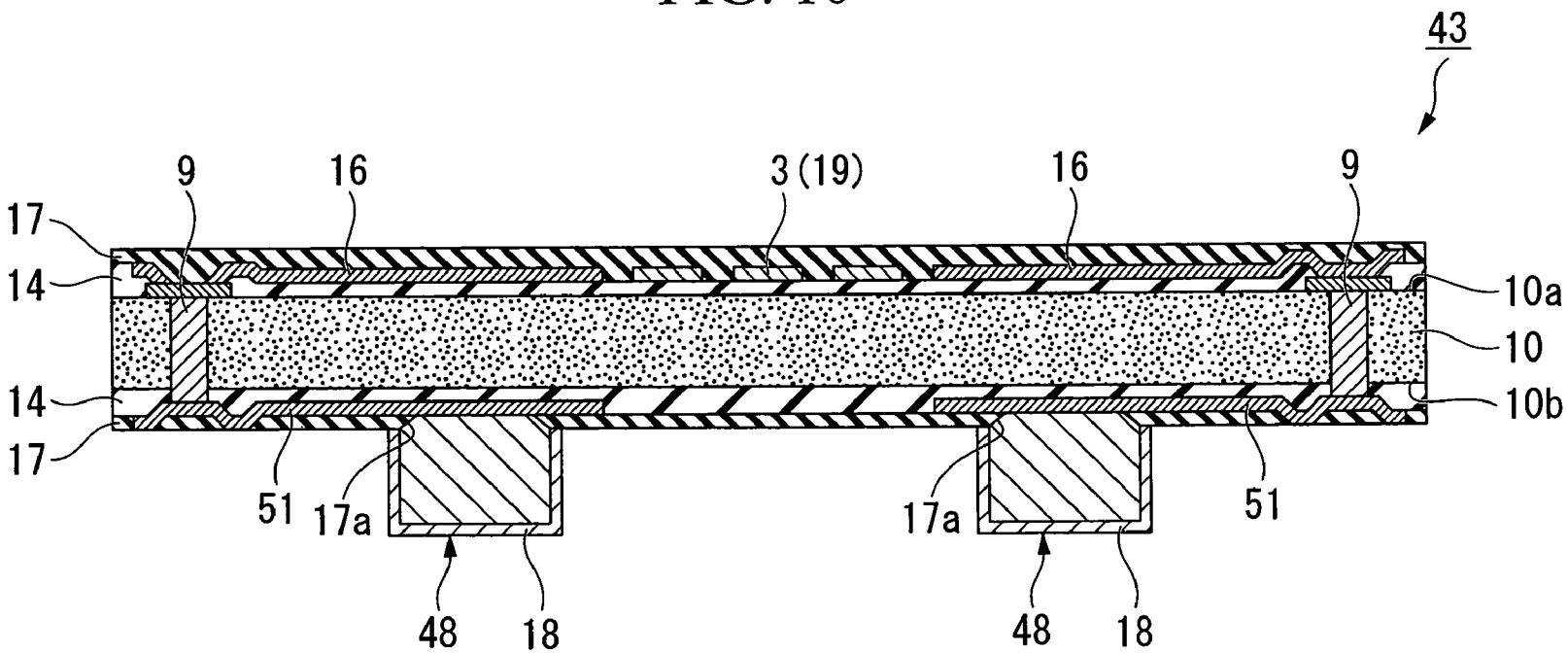
FIG. 10 is a cross-sectional view of a schematic diagram of a semiconductor device according to a fifth embodiment of the invention.

In FIG. 10, parts corresponding to those in FIGS. 1 to 6 are represented by same reference numerals, and are not repetitiously explained.

Reference numeral 43 represents a semiconductor device of this embodiment.

A second antenna 3 is formed on or above an active element formation face 10*a* of a semiconductor substrate 10, and liquid contact electrodes 48 are formed on a rear face 10*b*.

As shown in FIG. 10, in this embodiment, the relocation interconnections 16 and the second antenna 3 (relocation interconnections 19) are formed directly on a passivation film 14 on or above the active element formation face 10*a*.

Relocation interconnections 51 connect to the penetration electrodes 9, and are formed directly on a passivation film 14 on or above the rear face 10*b*.

The relocation interconnections 51 are exposed through openings 17*a* in a protective layer 17 formed on or above the rear face 10*b*.

Liquid contact electrodes 48 are then formed on the relocation interconnection 51 by forming bumps using the same method as in the above embodiment.

The liquid contact electrodes 48 formed by these bumps function as detection electrodes for detecting ink information.

By arranging the relocation interconnections 19 and 51 directly over the passivation film 14 without forming a dielectric layer 15 and an insulating layer 15', the configuration can be simplified, manufacture can be made easier, and the operating efficiency can be increased.

Sixth Embodiment

A sixth embodiment will be explained with reference to FIG. 11.

Figure 11:
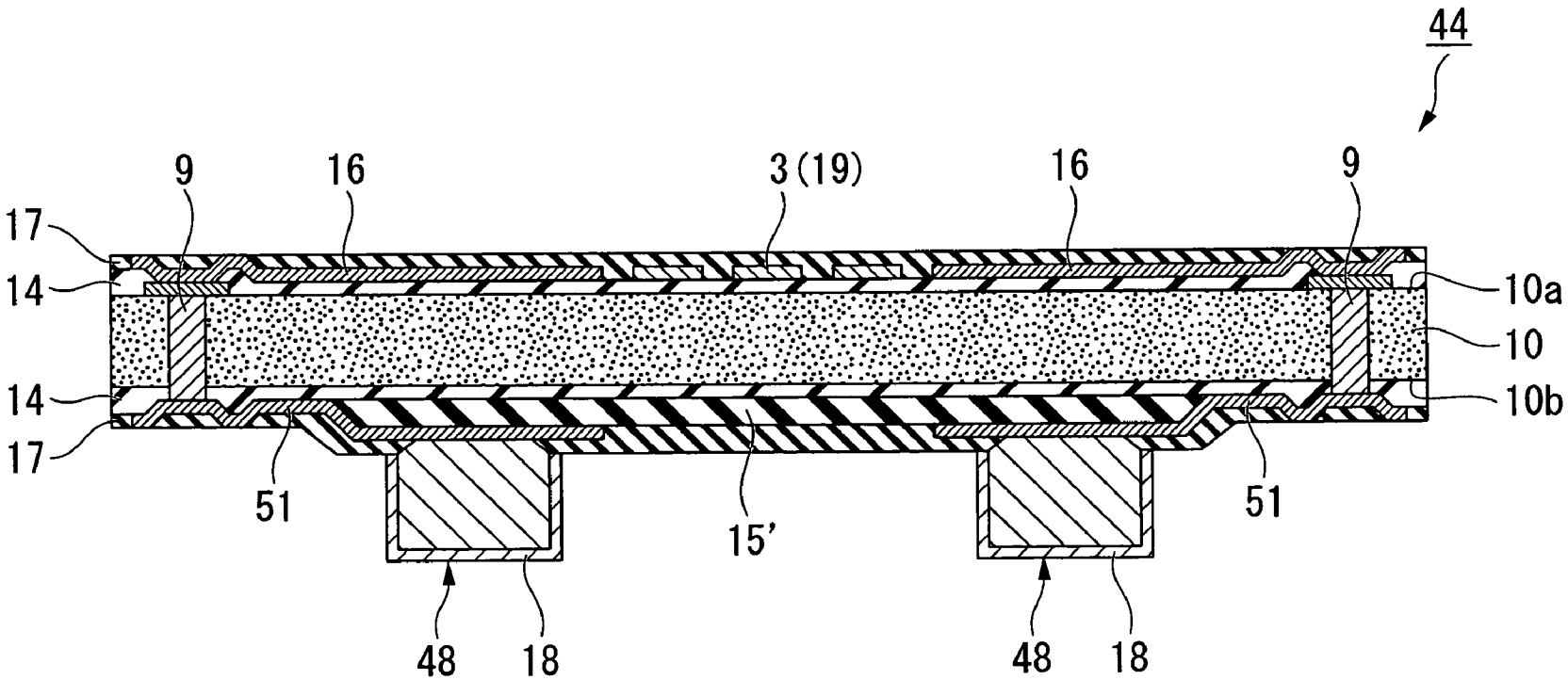
FIG. 11 is a cross-sectional view of a schematic diagram of a semiconductor device according to a sixth embodiment of the invention.

In FIG. 11, parts corresponding to those in FIGS. 1 to 6 and FIG. 10 are represented by same reference numerals, and are not repetitiously explained.

Reference numeral 44 represents a semiconductor device of this embodiment.

This embodiment differs from the fifth embodiment in that an insulating layer 15' of insulating resin is provided on or below the under layer of the liquid contact electrodes.

The semiconductor device of this embodiment includes an insulating layer 15' that is substantially trapezoidal in a cross-sectional view, and is provided in a center portion of the rear face 10*b* of the semiconductor substrate 10 with the passivation film 14 therebetween.

By forming the relocation interconnection 51 that connects to the penetration electrodes 9 so as to rise onto this insulating layer 15', the liquid contact electrodes 48 are inevitably moved to a greater distance from the rear face 10*b*.

By increasing the distance between the rear face 10*b* and the liquid contact electrodes 48 in this manner, the rear face 10*b* can be further prevented from being affected by the ink.

All the relocation interconnections 19 that constitute the second antenna 3 are formed on the same face on the passivation film 14 only in this embodiment and the fifth embodiment, whereas in the cross-sectional views of FIGS. 10 and 11 they can be formed in other arrangements.

Seventh Embodiment

A seventh embodiment will be explained with reference to FIG. 12.

Figure 12:
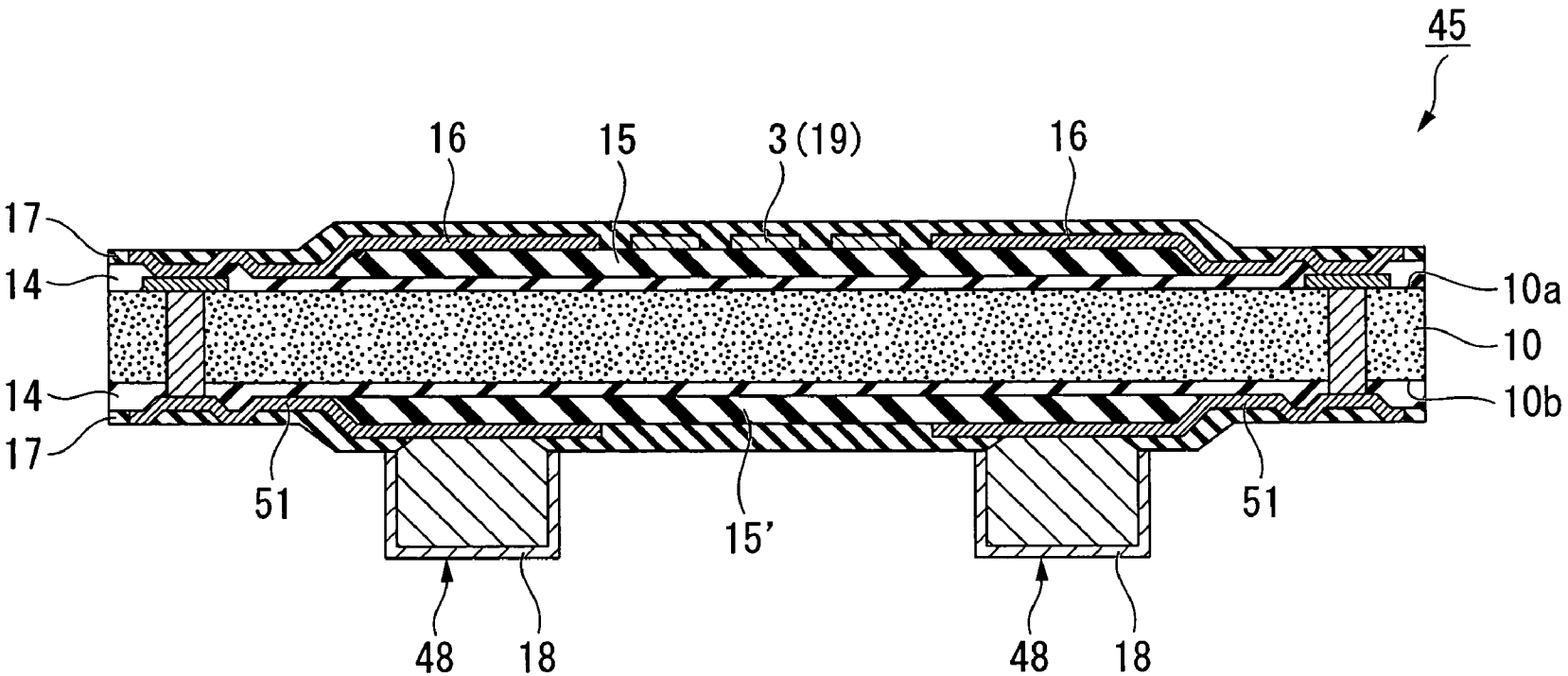
FIG. 12 is a cross-sectional view of a schematic diagram of a semiconductor device according to a seventh embodiment of the invention.

In FIG. 12, parts corresponding to those in FIGS. 1 to 6, 10, and 11 are represented by same reference numerals, and are not repetitiously explained.

Reference numeral 45 represents a semiconductor device of this embodiment, the basic configuration of which is similar to those of the fifth and six embodiments described above.

This embodiment differs from the fifth and sixth embodiments in that, in addition to forming the insulating layer 15' on or above the rear face 10*b* of the semiconductor substrate 10, a dielectric layer 15 is formed on or above the active element formation face 10*a*.

In the semiconductor device 45, the dielectric layer 15 is formed in a center portion of the active element formation face 10*a* with a passivation film 14 therebetween, and the insulating layer 15' is formed in a center portion of the rear face 10*b* with a passivation film 14 therebetween.

By using this configuration including the dielectric layer 15 on or below the under layer of the second antenna 3, the antenna characteristics can be enhanced.

Also, by forming the insulating layer 15' on or below the under layer of the liquid contact electrodes 48, the distance from the rear face 10*b* to the liquid contact electrodes 48 can increased in the same manner as the above embodiment, preventing the semiconductor substrate 10 from being affected by the ink.

It is preferable that the insulating layer 15' be formed from the same material as that of the dielectric layer 15. By this means, it is possible to form them in the same manufacturing step.

Since the liquid contact electrodes 46, 47, and 48 in the third to seventh embodiments detect ink information by being wet in the ink, their surfaces are plated with a metal having chemical resistance as in the first and second embodiments, so as to form an Au-plated film 18 (the plated film on the liquid contact electrodes 46 is not shown in FIG. 8).

Since the formation of this Au-plated film 18 prevents ink from infiltrating the semiconductor devices 41 to 45 from the openings 17*a*, the active elements (integrated circuit) can be prevented from being affected by the ink on the active element formation face 10*a* of each of the semiconductor devices 41 to 45 in these embodiments, or the entire semiconductor substrate 10 including them can be prevented from being affected by the ink.

Instead of silicon, another material such as glass, quartz, and liquid crystal can be used in forming the semiconductor substrate 10.

Instead of an EEPROM, a storage element such as a Flush MEMORY can be used as the EEPROM 4.

Moreover, provided that the second antenna 3 does not interfere with the positions of the relocation interconnections 16 and consequently does not limit the freedom of their design, interconnections can be extracted from the electrodes 20*a* and 20*b* to an arbitrary position, and bumps or the like independent of the relocation interconnection 19 and the electrodes 20*a* and 20*b* can be formed.

Instead of using the relocation interconnection 19 to form the second antenna 3, the second antenna 3 can be formed from an interconnection (Al, Cu) or the like used when forming the integrated circuit.

The same goes for the relocation interconnections 16.

The above embodiments describe semiconductor devices 1 and 40 to 45 wherein the second antenna 3 and the liquid contact electrodes 12 and 46 to 48 are formed on the semiconductor substrate 10. Alternatively, for example, when desiring to further enhance the performance of the second antenna unit, each of the semiconductor devices 1 and 40 to 45 can be configured as an all-in-one module structure mounted on a separate high-performance antenna. A semiconductor device having an all-in-one module structure can also be arranged in a single piece with a relay antenna.

Ink Cartridge

Subsequently, an ink cartridge 7 in this embodiment will be explained with reference to FIGS. 1, 2, 13, and 14.

The ink cartridge 7 contains one of the semiconductor devices 1 and 40 to 45 described above, and is attached to a printer unit 23 (electronic device) including a first antenna 22, as described below.

The semiconductor devices 1 and 40 to 45 contained in the ink cartridge 7 functions as wet sensors for managing and detecting ink information of the ink cartridge 7.

This embodiment describes an ink cartridge 7 that contains the semiconductor device 1.

The ink cartridge 7 is formed in a single piece by, for example, resin injection molding, such that the semiconductor device 1 is accommodated inside an ink cartridge casing 8 including an ink tank 6 that contains ink.

A pair of liquid contact electrodes 12 of the semiconductor device 1 is exposed in the ink tank 6 containing the ink.

Parts of the semiconductor device 1 other than the liquid contact electrodes 12 are embedded in the ink cartridge casing 8.

The semiconductor device 1 is arranged below a wall section of the ink cartridge casing 8 such that the pair of liquid contact electrodes 12 run along a bottom face of the ink tank 6.

By exposing the liquid contact electrodes 12 provided on or above the rear face 10*b* in the ink tank 6, the semiconductor device 1 is inevitably contained such that its active element formation face 10*a* faces the printer unit 23.

Therefore, the second antenna 3 formed on the active element formation face 10*a* faces the first antenna 22 on the printer unit 23.

In this structure, it is possible to send information that is transmitted and received directly to the printer unit 23 without passing the semiconductor substrate 10, which is an electromagnetic wave absorber.

Thus, the transmission distance is shortened, and the noise liability is reduced.

A predetermined ink is contained in the ink tank 6 of the ink cartridge 7, and the ink can be fed out from a predetermined location in the ink cartridge 7.

According to this configuration, the liquid contact electrodes 12 of the semiconductor device 1 can be exposed in the ink tank 6 of the ink cartridge casing 8. By this means, the liquid contact electrodes 12 are directly contact to the ink, and it is possible to reliably detect the remaining amount of ink (whether ink is present) in the ink tank 6.

Embedding parts of the semiconductor device 1 other than the liquid contact electrodes 12 in the ink cartridge 7, it is possible to prevent the active elements formed in these other parts from being damaged by the ink.

Furthermore, unwanted leakage of the ink solution can be prevented. The user's satisfaction is increased.

In addition, since the semiconductor device 1 can be arranged with the liquid contact electrodes 12 and the EEPROM 4 on the same substrate, even if the ink cartridge 7 is not set in the printer unit 23, it is possible to refer to content information of the controller 5, write to the EEPROM 4, etc.

In addition, ink information from the liquid contact electrodes 12 can be stored in the EEPROM 4 without passing through the printer unit 23.

For example, at the time of manufacturing the ink cartridge 7, ink manufacturing information or the like can be transmitted and received collectively for each packaging unit of the ink cartridge 7.

Furthermore, ink information such as whether the container has been filled with ink, the filling date, the ink depleted date, the number of fillings, and so on, can be stored in the EEPROM 4 before shipment from the factory, it is possible to manage this information collectively with detailed information relating to the ink itself.

By this means, it is possible to substitute the ink cartridge 7 without leaving ink in the ink tank 6.

The ink cartridge 7 can contain a plurality of the semiconductor devices 1 in this case, for example, the liquid contact electrodes 12 are arranged at predetermined intervals along the depth direction of the ink tank 6 on the wall of the ink cartridge casing 8.

In this configuration, it is possible to detect the ink level, and to reliably ascertain the remaining amount of ink and the consumption course.

At this time, it is possible to reliably detect whether ink is present by arranging the liquid contact electrodes 12 of at least one semiconductor device 1 along the bottom face of the ink tank 6.

Alternatively, the semiconductor device 1 can be affixed inside the ink cartridge 7 after formation of the ink cartridge 7.

While this embodiment describes a configuration where the second antenna 3 and the semiconductor device 1 having the function of an ink depleted sensor are arranged in a single structure, when, for example, further enhancing the performance of the second antenna unit, an additional relay antenna can be provided and the system can be configured as an all-in-one module structure.

Figure 15:
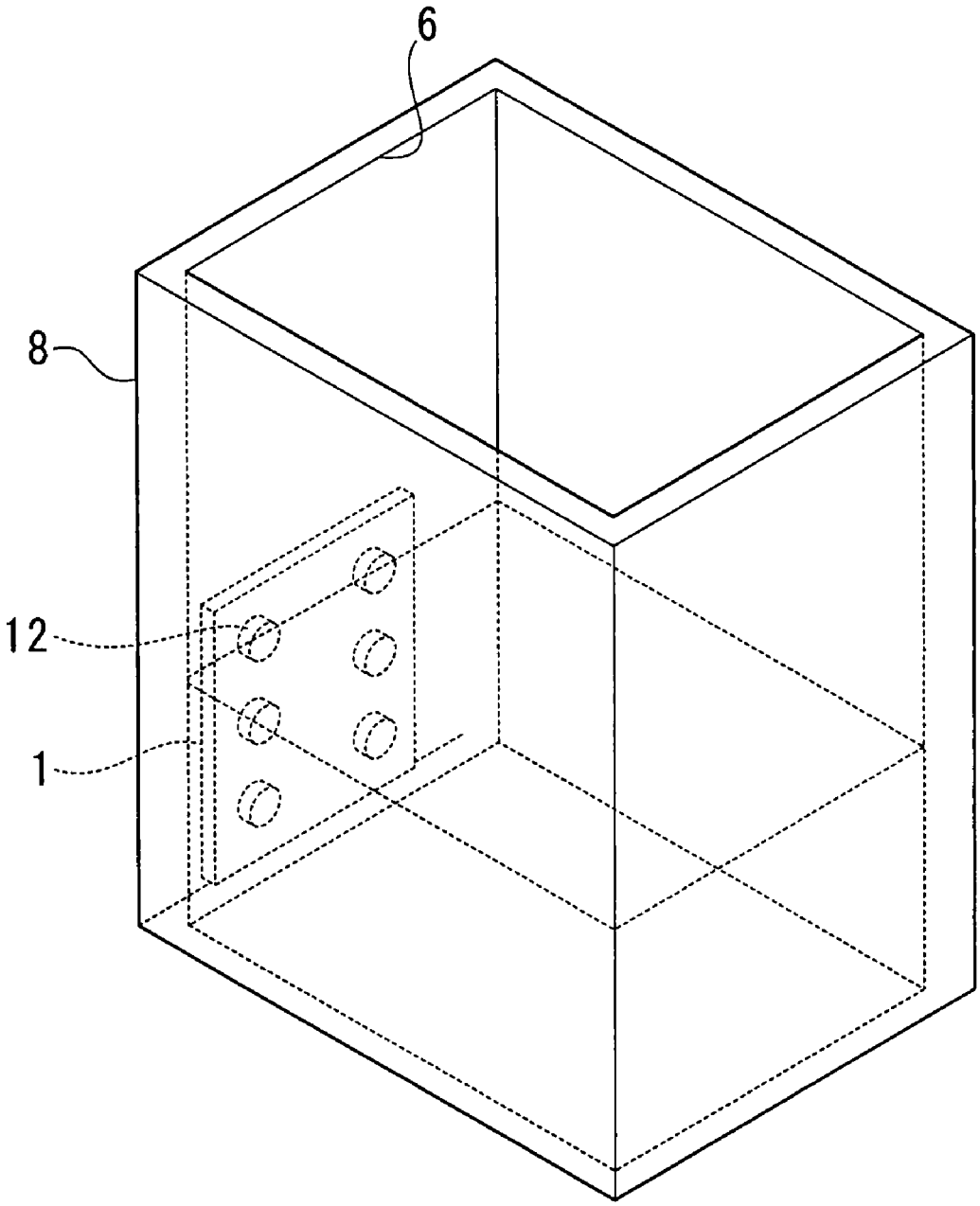
FIG. 15 is a plan view of a modification of an ink cartridge.

FIG. 15 is an example of another ink cartridge 7 of the invention.

As shown in FIG. 4, the semiconductor device 1 used here includes three pairs of liquid contact electrodes 12.

The semiconductor device 1 is arranged along the depth direction of the ink tank 6 near the bottom of the inner wall of the ink cartridge casing 8.

Since there are three pairs of (i.e., six) liquid contact electrodes 12, the ink level can be detected by measuring which pair of liquid contact electrodes 12 the ink is contacting, and the remaining amount of ink and the consumption course can be reliably ascertained.

At this time, if at least one pair of liquid contact electrodes 12 is arranged along the bottom face of the ink tank 6, it is possible to reliably detect whether ink is present.

By this means, it is possible to detect the abovementioned information by the semiconductor device 1, and achieves high-performance detection with a simple configuration.

More than three pairs of liquid contact electrodes 12 can be provided, more detailed ink information can be obtained.

Subsequently, a printer unit will be explained with reference to FIGS. 1, 2, 13, and 14.

Figure 13:
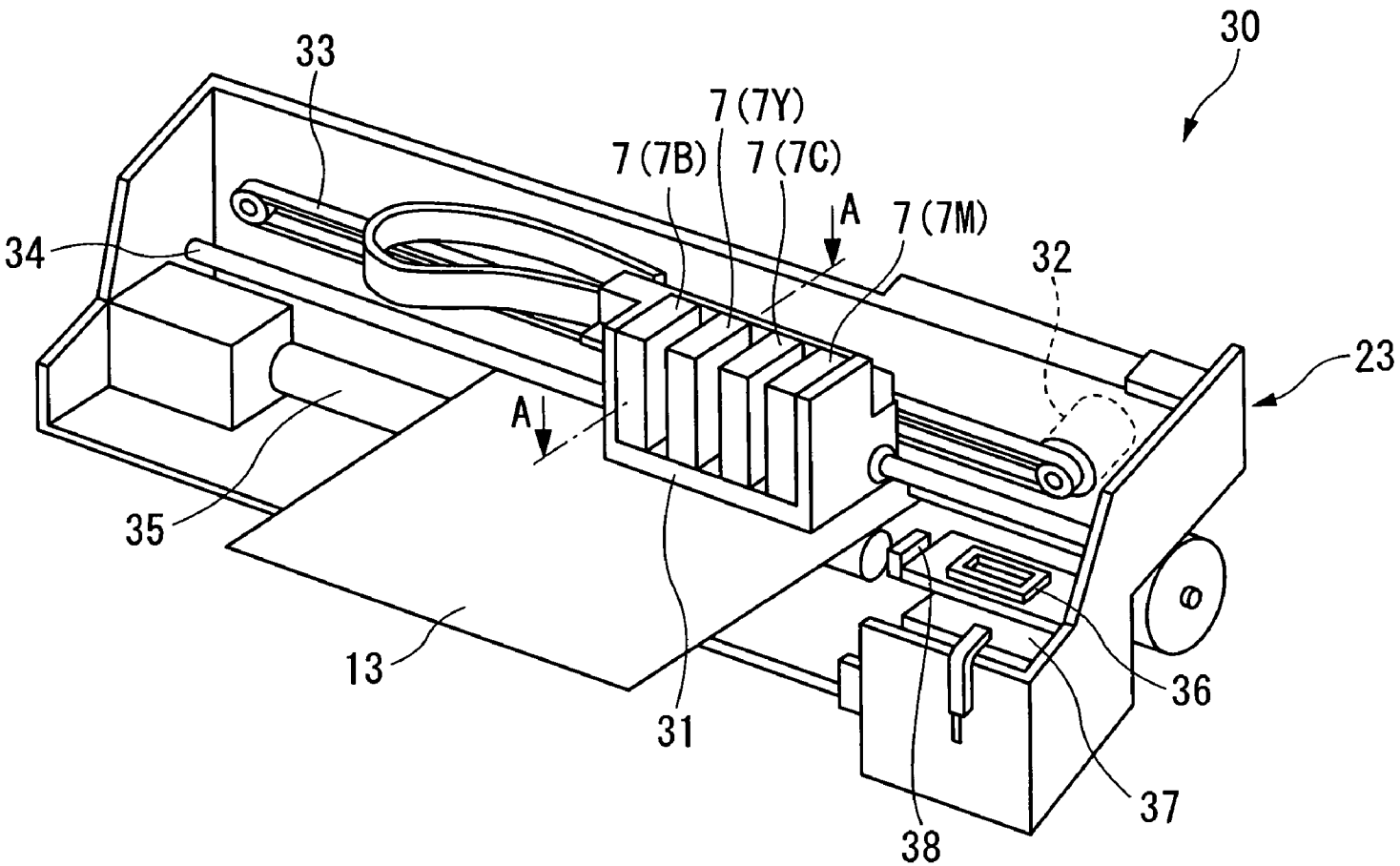
FIG. 13 is a perspective view of the main configuration of an ink jet printer wherein an ink cartridge containing a semiconductor device is attached to a printer unit.

As shown in FIG. 13, a printer unit 23 includes a plurality of the abovementioned ink cartridges 7, which can be inserted and removed.

The printer unit 23 includes a recording head and a paper handling mechanism.

Ink is supplied from each ink cartridge to the recording head.

The paper handling mechanism delivers recording paper 13 relative to the recording head.

The printer unit 23 prints onto the recording paper 13 by ejecting ink onto it while moving the recording head in accordance with printing data.

Figure 14:
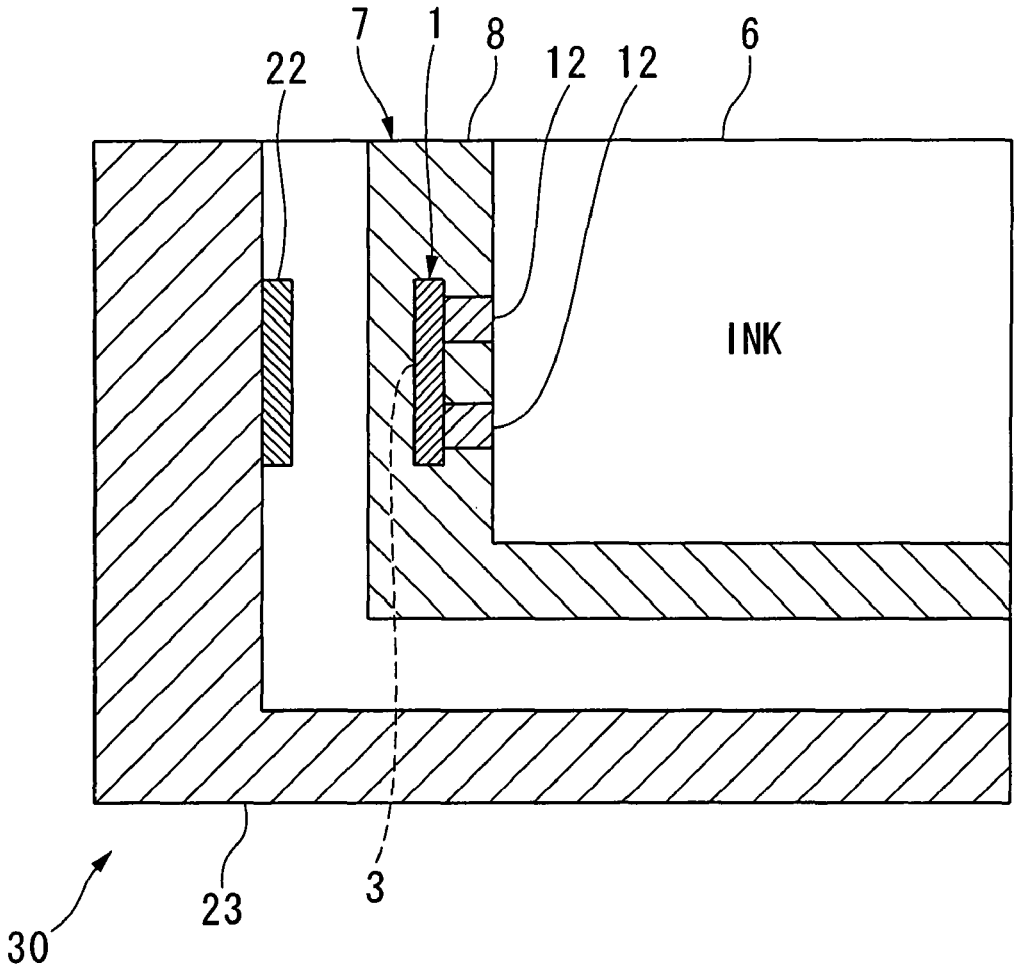
FIG. 14 is a cross-sectional view for explanation of an ink cartridge of the invention.

As shown in FIG. 14, the printer unit 23 includes a first antenna 22.

The first antenna 22 communicates with second antennas 3 formed on each of the ink cartridges 7.

The first antenna 22 is arranged facing the second antennas 3.

The printer unit 23 also includes a droplet ejection counter (not shown) that counts the number of ink droplets ejected from the ink cartridges 7, and calculates the remaining amount of ink from the amount of ink consumed.

As shown in FIG. 13, a plurality of ink cartridges 7 is attached in the printer unit 23.

The plurality of ink cartridges 7 is attached in parallel in an arrangement that is determined in advance according to the type of ink they contain.

Ink information is transmitted and received between the printer unit 23 and each ink cartridge 7 via wireless communication between the first antenna 22 and the second antenna 3.

Using the antennas 3 and 22, information can be transmitted and received between the ink cartridge 7 and the printer unit 23 without contact between them.

By this means, reliability is increased, since there is no concern regarding electrical contact between the printer unit 23 and the ink cartridges 7 as in the related art. The user's satisfaction can be greatly increased.

The information management cost can thereby be reduced.

The number of first antennas 22 on the printer unit 23 may be same as the number of ink cartridge 7.

To reduce the number of first antennas 22 on the printer unit 23, more than one first antenna 22 can be provided such that information relating to each ink cartridge 7 is transmitted and received every time a carriage 31 (described below) moves.

When the ink cartridge 7 of this embodiment is attached in the printer unit 23, a required power can be extracted from electromagnetic waves that are used as carrier waves of the ink information output from the first antenna 22, and this power can be used to drive the semiconductor device 1.

With this arrangement, the second antenna 3 can jointly perform the functions of transmitting/receiving information and receiving power.

Furthermore, communication between the first antenna 22 and the second antenna 3 on the ink cartridge 7 can be used in determining whether the ink cartridge 7 has been correctly attached in the printer unit 23.

At this time, for example, when the ink cartridge 7 is not correctly attached to the printer unit 23, this fact is displayed on a display unit or a computer screen.

Since the semiconductor device 1 is incorporated in a single piece with the ink cartridge 7 be injection molding, ink in the ink tank 6 can be made reliably airtight with the outside of the ink cartridge 7.

Therefore, ink does not leak from the part where the semiconductor device 1 is embedded, and ink leakage from the ink cartridge 7 is avoided.

By covering the liquid contact electrodes 12 with resin during the embedding process, it is possible to prevent incorrect determinations when the remaining amount of ink becomes small.

Since ink information from the electronic device unit (color, count number of ejected droplets, etc.) and ink information from the detection electrodes on the ink cartridge (remaining amount, actual amount, etc.) can be stored collectively in the ink cartridge 7 that includes the semiconductor device I configured in one piece from the controller 5, the EEPROM 4, and the second antenna 3, a broad range of information relating to the ink can be managed.

The ink information stored in the EEPROM 4 of the ink cartridge 7 is preserved even if the power of the printer unit 23 is turned off and when the ink cartridge 7 is removed from the printer unit 23, whereby the ink information can be detected and managed in ink cartridge units, enabling the versatility of the ink cartridge 7 to be increased.

In this semiconductor device 1, it is possible to impart ink management and detection functions to the ink cartridge 7, whereby the structure can be simplified by reducing the number of interconnections on the printer unit 23.

By this means, it is possible to increase the freedom of the design layout of the printer unit 23.

As mentioned above according to the effects of the invention, detailed information relating to the ink can be provided, achieving a remarkable increase in satisfaction for the user.

The same goes of an electronic device described below.

The ink cartridge 7 can include a display unit for displaying ink information stored in the EEPROM 4.

When using independent ink cartridges 7 for each color or the like, it is preferable that a semiconductor device 1 be incorporated in each independent ink cartridge 7 in order to transmit and receive information thereof.

A first antenna 22 on the printer unit 23 can be provided for each ink cartridge 7.

To reduce the number of first antennas 22 of the printer unit 23, one or more antennas can be provided so as to transmit/receive information of each ink cartridge 7 every time a carriage 31 (described below) moves.

With this configuration, an analog wetted signal from the liquid contact electrodes 12 can be output directly from the antenna as a digital signal via the controller 5.

Furthermore, the number of mechanical connection points can be reduced, and the information can be output on a stable digital signal instead of an unstable analog signal that is vulnerable to noise.

Electronic Device

Subsequently, a primary configuration of an inkjet printer 30 (electronic device) according to the invention will be explained based on the embodiment shown in FIG. 13.

The inkjet printer 30 includes a plurality of ink cartridges 7 that can be attached and removed to or from the printer unit 23.

In FIG. 13, reference numeral 31 represents a carriage. This carriage is guided by a guide rod 34 while moving back and forth along the axial direction of a platen 35 by means of a timing belt driven by a carriage motor 32.

The recording paper 13 is arranged in a scanning region scanned by the carriage 31, and is carried at a right angle to the scanning direction of the carriage 31.

A recording head is provided on a face of the carriage 31 that is opposite the recording paper 13.

Ink cartridges 7B, 7Y, 7C, and 7M that supply inks in colors of black, yellow, cyanogen, and magenta to the recording head are removably attached to its top.

A capping mechanism 36 is provided at a home position that is outside a non-printing region.

When the carriage 31 moves to the home position, in conjunction with the movement of the carriage 31, the capping mechanism 36 seals a nozzle formation face of the recording head that is mounted on the carriage 31.

The second antenna 3 of the ink cartridges 7 and the first antenna 22 (the first antenna 22 provided on the opposing section of the printer unit) face each other at the home position as shown in FIG. 14.

Consequently, each time one of the ink cartridge 7 returns to the home position, its ink information can be transmitted/received between its second antenna 3 and the first antenna 22.

Since this embodiment uses wireless communication, the configuration is not limited to that described above, it being possible to arrange the first antenna 22 at a position other than above each of the second antennas 3, thereby increasing the freedom of the unit design.

The capping mechanism 36 falls in conjunction with the movement of the carriage 31 toward the printing region, whereby the sealed state of the recording head can be cancelled.

A suction pump 37 is provided below the capping mechanism 36, and applies negative pressure to an internal space of the capping mechanism 36.

The capping mechanism 36 functions as a lid for preventing drying of the nozzle opening of the recording head while the inkjet printer 30 is not is use.

The capping mechanism 36 also functions as an ink receiver when a flushing operation is performed in order to eject ink droplets by applying a drive signal unrelated to printing to the recording head.

Moreover, the capping mechanism 36 also functions as a cleaning mechanism that performs suction emission of ink from the recording head by applying the negative pressure from the suction pump 37 to the recording head.

A wiping member 38 made from an elastic plate of rubber or the like is arranged adjacent to a region of the capping mechanism 36 which is closer to the printing region.

When necessary, the wiping member 38 performs a cleaning operation by wiping the nozzle formation face of the recording head as the carriage 31 moves back and forth to or from the capping mechanism 36.

The inkjet printer 30 moves the recording paper 13 relative to the inkjet recording head which receives the supply of ink from the ink cartridges 7.

Recording is performed by ejecting ink droplets onto the recording paper 13 while moving the recording head in accordance with the printing data.

Figure 16:
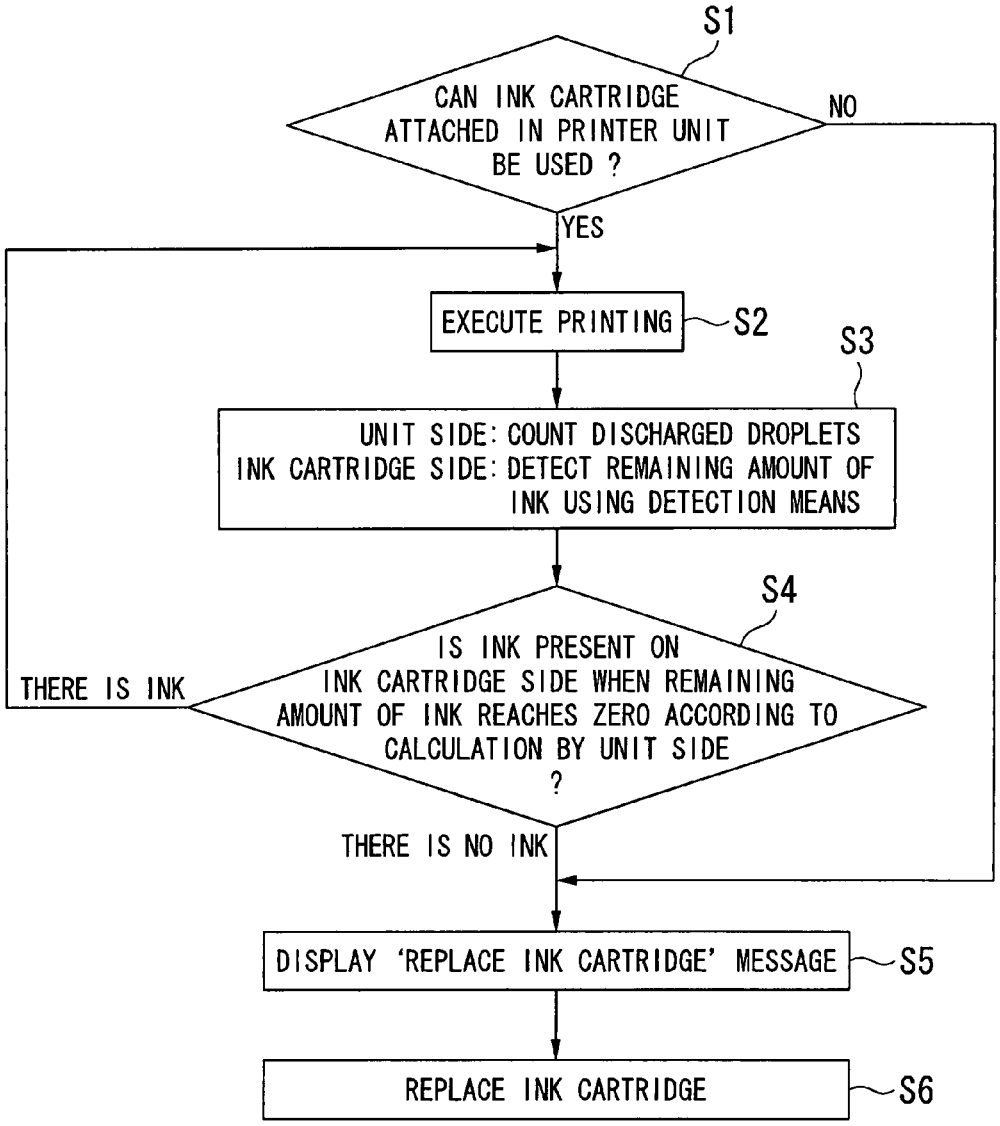
FIG. 16 is a flowchart of an ink jet printer system.

Subsequently, a system of the inkjet printer 30 will be explained with reference to FIG. 16.

Firstly, the ink cartridge 7 is attached to the printer unit 23.

In step S1, whether the ink cartridge 7 attached to the printer unit 23 can be used is detected. At this time, signals are transmitted and received between the first antenna 22 and the second antenna 3.

Power is then supplied to the second antenna 3 from the printer unit 23 by transmitting a signal from the first antenna 22, activating the IC of the semiconductor device 1 and applying a predetermined voltage to the liquid contact electrodes 12.

When the ink tank 6 contains ink, current flows between the liquid contact electrodes 12 while passing through the ink touching them.

Signals (current values) detected by the liquid contact electrodes 12 are output to the controller 5.

When the signal detected by the liquid contact electrodes 12 indicates conductivity between them, the controller 5 determines that ink is present and supplies ink information (indicating whether ink is present) based on this determination to the EEPROM 4.

When that the ink cartridge 7 can be used is determined, information indicating this is sent to the printer unit 23. The printer unit 23 enters a print standby state, and, when the printer unit 23 receives a print signal, recording of the printing data is executed as shown in step S2.

On the other hand, when the detected signal indicates that there is no conductivity between the liquid contact electrodes 12, the controller 5 determines that there is no ink ('ink depleted' state).

Ink information (indicating whether ink is present) based on that determination is stored in the EEPROM 4, and the procedure shifts to step S5, in which a signal requesting replacement of the ink cartridge 7 is output to the printer unit 23.

By detecting the conductive state between the liquid contact electrodes 12 in this way, whether ink is present in the ink tank 6 is confirmed, and the usability of the ink cartridge 7 can be determined.

As shown in step S2, when the printer unit 23 is being driven so as to execute printing, as shown in step S3, the ink cartridge 7 detects the conductive state between the liquid contact electrodes 12 at predetermined times.

The detection signal (current value) detected by the liquid contact electrodes 12 is output to the controller 5.

The detection cycle of the ink information is adjusted as appropriate.

The controller 5 constantly updates the ink information of the EEPROM 4 based on the determination result.

In this manner, the remaining amount of ink (presence of ink) is monitored.

The controller 5 outputs the ink information stored in the EEPROM 4 via the second antenna 3 to the printer unit 23, where the ink information is supplied to the user from a display unit or from a computer screen.

As shown in step S3, software on the printer unit 23 calculates the amount of remaining ink from the sum of a count number of ejected ink droplets and the amount of ink used in maintenance.

The result is sent to the EEPROM 4 of the ink cartridge 7 via the first antenna 22 at each predetermined time, and the EEPROM 4 manages the remaining mount of ink (consumption amount).

In this way, ink-related information of the insulating layer 44 is constantly updated based on a signal output from the first antenna 22 of the printer unit 23.

Information stored in the EEPROM 4 is then supplied from the EEPROM 4 via the second antenna 3 to the user by being displayed a computer screen or a display unit on the printer unit 23.

In this manner, the user can monitor the progress of ink consumption, confirm the remaining amount of ink, etc.

Shortly after printing starts, for example, a calculation result indicating that the remaining amount of ink has reached zero is transmitted from the printer unit 23 to the controller 5.

However, as shown in step S4, when the detection signal between the liquid contact electrodes 12 indicates that ink is present (i.e., when the status between the liquid contact electrodes 12 is conductive), that ink remains in the ink tank 6 is clear, and therefore, that there is no ink in the ink tank 6 is not determined at this point; the procedure returns to step S2 and recording of the printing data is continued.

Thereafter as shown in step S4, when a signal indicating that the liquid contact electrodes 12 have ceased to be conductive is detected on the ink cartridge 7, the controller 5 determines, based on that signal, that a state of 'ink depleted' has been reached, and updates the ink information in the EEPROM 4.

Since the pair of liquid contact electrodes 12 are provided along the bottom face of the ink tank 6, the fact that they cease being conductive indicates that there is no ink in the ink tank 6.

Since this is more reliable than the calculation of remaining amount of ink made by the droplet ejection counter, the controller 5 always gives priority to the signal from the liquid contact electrodes 12 that actually contact the ink.

A discrepancy between the remaining amount of ink amount from the droplet ejection counter and the actual amount of ink remaining in the ink tank 6 often occurs due to variation in the weight of the ink droplets and variation in the amount of ink injected at the time of manufacture.

Priority is given to the signal from the liquid contact electrodes 12 in order to prevent a command being made to replace the ink cartridge 7 even when there is ink remaining in the ink tank 6 after the controller 5 determines that the ink cartridge 7 has reached a state of 'ink depleted' at the point where the remaining amount of ink according to the droplet ejection counter reaches zero.

After determining that the ink is depleted based on the signal from the liquid contact electrodes 12, in step S5, the controller 5 outputs a signal requesting replacement of the ink cartridge 7 to the printer unit 23, and a warning is issued to the user from a display unit (not shown) of the printer unit 23 or a computer screen.

In this manner, the user can know when to replace the ink cartridge 7.

As shown in step S6, an ink cartridge 7 that has reached the ink depleted state is removed from the printer unit 23 and replaced with a new ink cartridge 7.

For example, if the remaining amount of ink calculated by the droplet ejection counter on the printer unit 23 indicates that ink remains even though the liquid contact electrodes 12 of the ink cartridge 7 clearly indicate that the ink in the ink tank 6 has reached the ink depleted state, this is regarded as an error on the printer unit 23, and an error message is displayed on a display unit of the printer unit 23 or on a computer.

When the printer unit 23 calculates that the remaining amount of ink is zero, if the amount of ink remaining in the ink cartridge 7 at that point is determined to be much greater than the remaining amount of ink caused by variation in the weight of the ink droplets, that the ink droplets being ejected are of a smaller amount than usual is assumed.

In this case, a message suggesting that, for example, the ink ejection head should be cleaned, is displayed on a display unit or a computer screen.

Thus the EEPROM 4 jointly manages ink information on the printer unit 23 and ink information that is detected using the liquid contact electrodes 12 of the ink cartridge 7, and detects errors in the printer unit 23 and the ink cartridge 7 by comparing these two types of information.

According to the inkjet printer 30 of this embodiment, since ink information can be reliably detected and managed with a simple configuration, it is possible to determine, for example, an appropriate replacement period of the ink cartridge 7.

As a result, since it is possible to replace the ink cartridge 7 without wasting ink, the replacement cycle of the ink cartridge 7 can be extended, reducing the cost for the user.

By managing the ink information in detail in this manner, the ink cartridge 7 can be recycled efficiently and without waste.

This achieves a function that is essential for servicing the user.

Furthermore for example, information such as the number of recycles of the ink cartridge 7 can be determined from information relating to the number of ink fillings, this information is useful not only to the user but also to the recycler (manufacturer).

Therefore, it is possible to provide a highly reliably, high-quality product that enables detection and management of information relating to ink in the ink cartridge to be performed accurately and reliably with a simple configuration.

While preferred embodiments of the invention have been described and illustrated above, these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A semiconductor device comprising:

a semiconductor substrate including an active element formation face on which an integrated circuit is formed, and a rear face that is on a side opposite to the active element formation face;

a penetration electrode penetrating the semiconductor substrate;

an element electrode formed on or above the active element formation face;

detection electrodes formed on or above the rear face, electrically connected to the element electrode via the penetration electrode, and detecting a remaining amount of the ink by being wet in the ink; and an antenna formed on either one of the active element formation face and the rear face, transmitting and receiving information;

wherein the integrated circuit includes a storage circuit storing the remaining amount of ink and a control circuit controlling the detection electrodes, the antenna, and the storage circuit.

2. The semiconductor device according to claim 1, wherein a part of the penetration electrode is the detection electrode.

3. The semiconductor device according to claim 2, wherein a part of the penetration electrode includes a protrusion protruding from the rear face, and the protrusion is the detection electrode.

4. The semiconductor device according to claim 1, further comprising:

a conductive layer formed on or above the rear face of the semiconductor substrate with a passivation film therebetween;

a protective film formed so as to cover the conductive layer; and an opening formed on the protective film, exposing at least a part of the conductive layer, wherein the detection electrode is constituted by the part of the conductive layer exposed through the opening.

5. The semiconductor device according to claim 1, further comprising:

a conductive layer formed on or above the rear face of the semiconductor substrate with a passivation film therebetween;

a protective film formed so as to cover the conductive layer; and an opening formed on the protective film, exposing at least a part of the conductive layer; and a bump formed on the conductive layer exposed through the opening, wherein the bump is the detection electrode.

6. The semiconductor device according to claim 1, further comprising:

an insulating layer formed on or below a bottom layer of the detection electrodes.

7. The semiconductor device according to claim 1, wherein the antenna and the detection electrodes are formed directly on the active element formation face or the rear face using the same conductive material as that constituting the integrated circuit.

8. The semiconductor device according to claim 1, further comprising:

a plated film formed on a surface of the detection electrode.

9. The semiconductor device according to claim 1, further comprising:

a dielectric layer formed on or below a bottom layer of the antenna.

10. The semiconductor device according to claim 1, further comprising:

three or more detection electrodes.

11. An ink cartridge used for an electronic device unit including an antenna, the ink cartridge comprising:

an ink cartridge casing including a container that accommodates ink; and a liquid sensor including a semiconductor device that detects and manages information relating to the ink accommodated in the container, wherein the semiconductor device includes:

a semiconductor substrate including an active element formation face on which an integrated circuit is formed, and a rear face that is on a side opposite to the active element formation face;

a penetration electrode penetrating the semiconductor substrate;

an element electrode formed on or above the active element formation face;

detection electrodes exposed in the container, formed in the ink cartridge casing, formed on or above the rear face, electrically connected to the element electrode via the penetration electrode, and detecting a remaining amount of the ink by being wet in the ink; and a first antenna formed on either one of the active element formation face and the rear face, transmitting and receiving information, wherein the integrated circuit includes a storage circuit storing the remaining amount of ink, and a control circuit controlling the detection electrodes, the first antenna, and the storage circuit.

12. The ink cartridge according to claim 11, wherein a plurality of pairs of the detection electrodes of the semiconductor device are formed along the depth direction of the container, the detection electrodes being arranged along a bottom face of the container.

13. The ink cartridge according to claim 12, wherein a plurality of the semiconductor devices are formed along the depth direction of the container, the detection electrodes of at least one of the semiconductor devices being arranged along a bottom face of the container.

14. An electronic device comprising:

the ink cartridge according to claim 11; and an electronic device unit including a second antenna.

* * * * *